US009557660B2

(12) United States Patent
Takahashi et al.

(10) Patent No.: US 9,557,660 B2
(45) Date of Patent: Jan. 31, 2017

(54) ELECTROPHOTOGRAPHIC PHOTOSENSITIVE MEMBER, PROCESS CARTRIDGE, ELECTROPHOTOGRAPHIC APPARATUS, CHARGE TRANSPORT LAYER FORMING COATING LIQUID, AND METHOD FOR MANUFACTURING ELECTROPHOTOGRAPHIC PHOTOSENSITIVE MEMBER

(71) Applicant: CANON KABUSHIKI KAISHA, Tokyo (JP)

(72) Inventors: Koji Takahashi, Kashiwa (JP); Naoaki Ichihashi, Abiko (JP); Kan Tanabe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/150,710

(22) Filed: May 10, 2016

(65) Prior Publication Data

US 2016/0252831 A1 Sep. 1, 2016

Related U.S. Application Data

(63) Continuation of application No. 14/935,273, filed on Nov. 6, 2015.

(30) Foreign Application Priority Data

Nov. 11, 2014 (JP) ..... 2014-229323
Oct. 20, 2015 (JP) ..... 2015-206608

(51) Int. Cl.

| | |
|---|---|
| ***G03G 5/05*** | (2006.01) |
| ***G03G 5/06*** | (2006.01) |
| ***G03G 5/043*** | (2006.01) |

(52) U.S. Cl.

CPC ..... *G03G 5/0614* (2013.01); *G03G 5/043* (2013.01); *G03G 5/056* (2013.01); *G03G 5/0514* (2013.01); *G03G 5/0517* (2013.01); *G03G 5/0525* (2013.01); *G03G 5/0564* (2013.01); *G03G 5/0696* (2013.01)

(58) Field of Classification Search

CPC ..... G03G 5/43; G03G 5/056; G03G 5/0564; G03G 5/0614; G03G 5/0696

USPC ..... 399/159

See application file for complete search history.

(56) References Cited

U.S. PATENT DOCUMENTS 5,405,725 A * 4/1995 Nakamura ..... G03G 5/06 430/59.4
8,507,163 B2 * 8/2013 Tamoto ..... G03G 5/0614 399/159

* cited by examiner

*Primary Examiner* — Susan Lee
(74) *Attorney, Agent, or Firm* — Canon U.S.A., Inc., IP Division

(57) ABSTRACT

The subject invention relates to a charge transport layer forming coating liquid containing a charge transport material, at least one selected from the group consisting of polycarbonate resins and polyester resins, at least one of xylene and toluene, and cyclopentanone. The proportion of cyclopentanone in the charge transport layer forming coating liquid is in the range of 50% by mass to 85% by mass relative to the total mass of at least one of xylene and toluene and cyclopentanone.

5 Claims, 1 Drawing Sheet

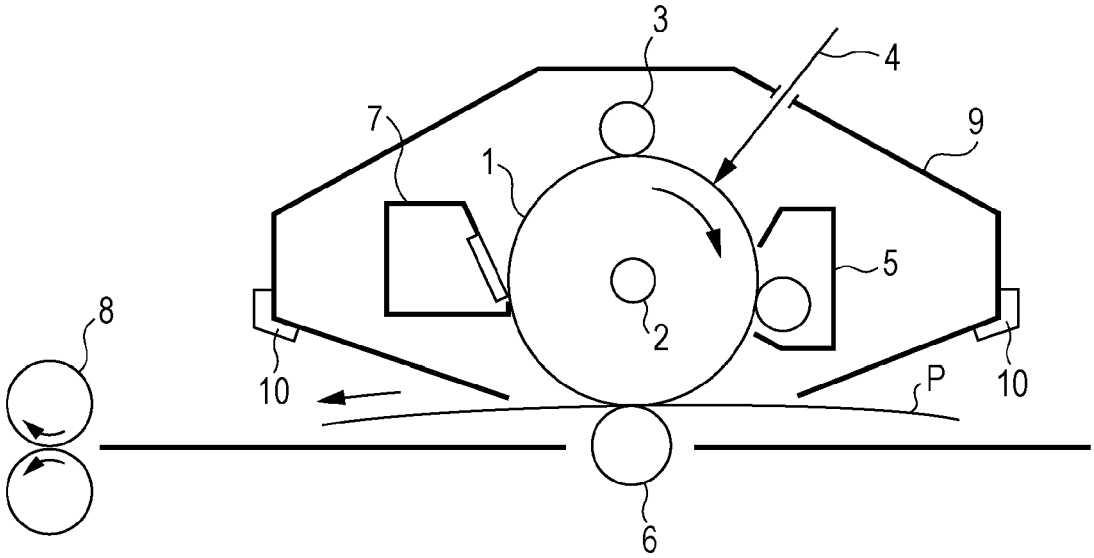
3
4
7
9
1
5
8
2
10
P
10
6

ELECTROPHOTOGRAPHIC PHOTOSENSITIVE MEMBER, PROCESS CARTRIDGE, ELECTROPHOTOGRAPHIC APPARATUS, CHARGE TRANSPORT LAYER FORMING COATING LIQUID, AND METHOD FOR MANUFACTURING ELECTROPHOTOGRAPHIC PHOTOSENSITIVE MEMBER

CROSS-REFERENCE TO RELATED APPLICATION

This is a continuation-in-part application of U.S. patent application Ser. No. 14/935,273 filed on Nov. 6, 2015.

BACKGROUND OF THE INVENTION

Field of the Invention

The present disclosure relates to an electrophotographic photosensitive member, a process cartridge, an electrophotographic apparatus, a charge transport layer forming coating liquid, and a method for manufacturing the electrophotographic photosensitive member.

Description of the Related Art

Electrophotographic apparatus users have recently been being diversified. It is desirable that the electrophotographic apparatus can output more high-quality images than ever without varying image quality over the period of use. Accordingly, it is also desirable that the electrophotographic photosensitive member incorporated in such an electrophotographic apparatus respond to these demands.

For forming high-quality images over a long time from the beginning, Japanese Patent Laid-Open No. 2013-142705 discloses an electrophotographic photosensitive member including a photosensitive layer having a surface layer containing 100 ppm by mass to 2500 ppm by mass of an aromatic hydrocarbon.

For suppressing the degradation of sensitivity, Japanese Patent Laid-Open No. 2004-4159 discloses an electrophotographic photosensitive member including a photosensitive layer containing a saturated alicyclic ketone with a content in the range of 3000 ppm to 50000 ppm relative to the solid content.

For suppressing fluctuations in potential, Japanese Patent Laid-Open No. 7-5703 discloses an electrophotographic photosensitive member including a photoconductive layer (photosensitive layer) containing 0.05% by weight to 10.0% by weight of cyclopentanone.

The applications of electrophotographic apparatuses are expanding. Some of the electrophotographic apparatuses come to be used for quick printing without being limited to use in offices. Accordingly, an electrophotographic photosensitive member suitable for highspeed processes is desired.

When the electrophotographic photosensitive member disclosed in Japanese Patent Laid-Open No. 2013-142705 was used in a high-speed process with substantially the same amount of light for image exposure as in a general process, however, the electrophotographic photosensitive member exhibited poor sensitivity, and a desired light portion potential was not obtained.

The electrophotographic photosensitive members disclosed in Japanese Patent Laid-Open Nos. 2004-4159 and 7-5703 also exhibited the same disadvantage in some cases.

For coating liquids for forming the layers of an electrophotographic photosensitive member, it is desirable that the solute be fully dissolved in the coating liquid, and that the coating liquid do not deteriorate during storage and have good coatability.

Japanese Patent Laid-Open No. 2001-343762 discloses a coating liquid for forming a charge transport layer (hereinafter referred to as charge transport layer forming coating liquid). In this coating liquid, a solvent made up of dimethoxymethane, ethylene glycol dimethyl ether, and an aromatic hydrocarbon (other than benzene) is used from the viewpoint of preventing the coating liquid from whitening.

Japanese Patent Laid-Open No. 2014-160238 discloses a charge transport layer forming coating liquid from the viewpoint of achieving both a high potential stability and a high abrasion resistance when the photosensitive member is repeatedly used. The coating liquid contains an aromatic hydrocarbon solvent and a compound having a higher boiling point than the aromatic hydrocarbon solvent at 1 atmosphere. Japanese Patent Laid-Open No. 6-308744 discloses a charge transport layer forming coating liquid containing a cyclic ketone as the solvent.

For the technique of Japanese Patent Laid-Open No. 2001-343762, it has been found that the charge transport layer forming coating liquid may gel when stored for a long time. It has also been found that the charge transport layer forming coating liquids disclosed in Japanese Patent Laid-Open Nos. 2014-160238 and 6-308744 may gel when stored under severer conditions for a long time.

SUMMARY OF THE INVENTION

The present disclosure provides a more highly sensitive electrophotographic photosensitive member, and a process cartridge and an electrophotographic apparatus that incorporates the more highly sensitive electrophotographic photosensitive member. The present disclosure also provides a charge transport layer forming coating liquid unlikely to thicken or gel even when stored for a long time, and a method for manufacturing an electrophotographic photosensitive member using the charge transport layer forming coating liquid.

According to an aspect of the present disclosure, there is provided an electrophotographic photosensitive member including a support member, and a charge generating layer and a charge transport layer that are disposed over the support member. The charge transport layer contains: (α) a charge transporting compound; (β) a binding resin in a proportion in the range of 50% by mass to 200% by mass relative to the mass of the charge transporting compound; (γ) a compound being at least one of xylene and toluene with a content in the range of 0.01% by mass to 2.00% by mass relative to the total mass of the charge transport layer; and (δ) a cycloalkanone with a content in the range of 0.01% by mass to 1.20% by mass relative to the total mass of the charge transport layer.

According to another aspect of the present disclosure, there is provided a process cartridge capable of being removably attached to an electrophotographic apparatus. The process cartridge includes the above-described electrophotographic photosensitive member and at least one device selected from the group consisting of a charging device, a developing device, a transfer device, and a cleaning device. The electrophotographic photosensitive member and the device are held in one body.

Also, an electrophotographic apparatus is provided. The electrophotographic apparatus includes the above-described electrophotographic photosensitive member, a charging device, an exposure device, a developing device, and a transfer device.

According to still another aspect of the present disclosure, a coating liquid is provided for forming a charge transport layer. The coating liquid contains: (α') a charge transport material (charge transporting compound); (β') a resin selected from the group consisting of polycarbonate resins and polyester resins; (γ') at least one of xylene and toluene; and (δ') cyclopentanone. The proportion of (δ') in the charge transport layer forming coating liquid is in the range of 50% by mass to 85% by mass relative to the total mass of (γ') and (δ').

Furthermore, a method is provided for manufacturing an electrophotographic photosensitive member including a charge generating layer and a charge transport layer. The method includes forming a charge generating layer containing a charge generating material, and forming a charge transport layer by applying the charge transport layer forming coating liquid to form a coating film and drying the coating film.

Further features of the present invention will become apparent from the following description of exemplary embodiments with reference to the attached drawing.

BRIEF DESCRIPTION OF THE DRAWING

FIGURE is a schematic view of the structure of an electrophotographic apparatus provided with a process cartridge including an electrophotographic photosensitive member according to an embodiment of the invention.

DESCRIPTION OF THE EMBODIMENTS

As described above, the electrophotographic photosensitive member disclosed herein includes a support member and photosensitive layers including a charge transport layer over the support member, and the charge transport layer contains the above described components (α), (β), (γ) and (δ). In the following description, components (α), (β), (γ) and (δ) may be referred to as compound α, resin ϵ, compound γ, and compound δ, respectively. The electrophotographic photosensitive member may be simply referred to as the photosensitive member.

The present disclosure features a charge transport layer containing at least either xylene or (compound γ) and cycloalkanone (compound δ) each with a specific content, in comparison with Japanese Patent Laid-Open Nos. 2013-142705, 2004-4159 and 7-5703.

The present inventors assume as below the reason why the charge transfer layer containing compounds γ and δ each with a specific content is effective in providing more highly sensitive electrophotographic photosensitive member.

The present inventors believe that the charge transportability (hole transportability) of the charge transport material (for example, a charge transporting compound having a diphenylamine structure) is enhanced by adding specific amounts of compounds γ and δ to the charge transport layer. Consequently, the charge transport material can transport generated holes to the surface of the charge transport layer even if a latent image is formed by exposure at a low luminous energy, and thus the photosensitive member can exhibit a higher sensitivity than the known photosensitive members.

In order to enhance the hole transportability of the charge transport layer, the ratio of the charge transport material to the binding resin may be increased. The range of variable ratio is however limited in view of the degradation in durability of the photosensitive member and the storage stability of the coating liquid for forming the photosensitive member. According to the approach disclosed herein, the hole transportability of the charge transport material can be enhanced even if the ratio of the charger transport material to the binding resin in the charge transport layer is the same as in the known photosensitive members.

Furthermore, the charge transport layer forming coating liquid of the present disclosure features the solvent made up of (γ') at least one of xylene and toluene and (δ') cyclopentanone with a specific proportion, unlike the coating liquid disclosed in Japanese Patent Laid-Open No. 2001-343762. The charge transport layer forming coating liquid of the present disclosure contains (δ') cyclopentanone with a specific content, unlike the coating liquid disclosed in Japanese Patent Laid-Open No. 2014-160238.

The present inventors assume that the storage stability of the resulting charge transport layer can be increased by the composition containing (α'), (β'), (γ'), and (δ') each with a specific content.

If the charge transport material (α') and the resin (β') that is at least one selected from the group consisting of polycarbonate resins and polyester resins are added into solvent (γ'), the two materials (α') and (β') can be dissolved depending on the condition. Even if the two materials are dissolved, however, the molecules of (β') intertwine or aggregate to stabilize gradually in the coating liquid due to the low polarity of solvent (γ').

If the charge transport material (α') and the resin (β') are added into solvent (δ'), the two materials (α') and (β') can be dissolved more satisfactorily than the case of adding into solvent (γ'), and the coating liquid is prevented from gelling with time. In this instance, however, the resin (β') cannot be sufficiently prevented from stabilizing under severe conditions where a temperature cycle of high temperature and low temperature is repeated, because the polarity of solvent (δ') is excessively high.

In the case of dissolving the charge transport material (α') and the resin (β') in a mixture of solvents (γ') and (δ') with a specific proportion, the polarity of the mixture as a whole is optimized. Since the resin (β') can be more potentially stable when it is dissolved in the mixture of (γ') and (δ') than when it is dissolved in either (γ') or (δ') and thus stabilized, thereby aggregating or gelating, it is expected that the use of the mixture can hamper the gelation with time.

In addition, it is assumed that the molecular weights of (γ') and (δ') are suitable to efficiently hamper the aggregation of (α') and (β').

Compound α

Compound α is at least one of the charge transport materials. Charge transport materials that can be used in an embodiment of the disclosure include triarylamine compounds, hydrazone compounds, styryl compounds, stilbene compounds, and enamine compounds. These compounds are charge transporting compounds having a diphenylamine structure.

(A)

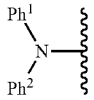

In general formula (A), $Ph_1$ and $Ph_2$ each represent substituted or unsubstituted phenyl.

Desirably, compound α is expressed by any one of formulas (A-1) to (A-9) and has a molecular weight of 3000 or less. More desirably, compound α is a charge transport material having a partial structure expressed by the following general formula (B), such as compounds (A-1) to (A-3), (A-5) and (A-6). Compounds (A-1) to (A-3) are particularly desirable.

(B)

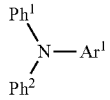

In general formula (B), $Ph_1$ and $Ph_2$ each represent substituted or unsubstituted phenyl, and $Ar_1$ represents substituted or unsubstituted aryl.

(A-1)

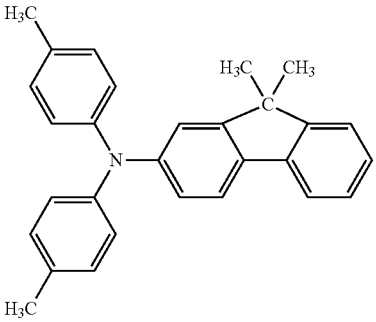

(A-2)

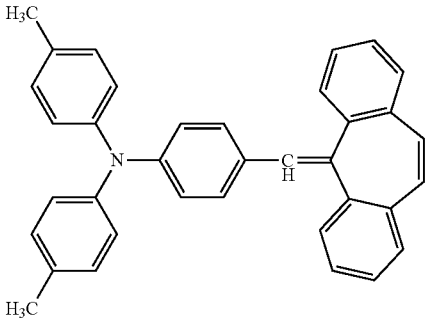

(A-3)

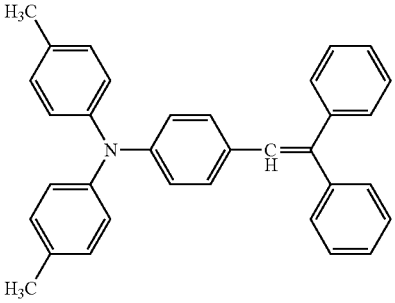

(A-4)

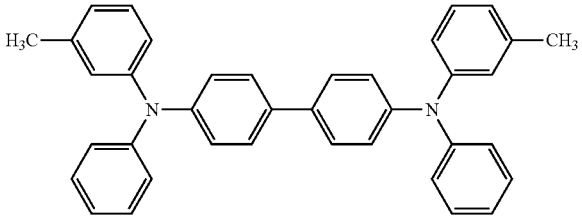

(A-5)

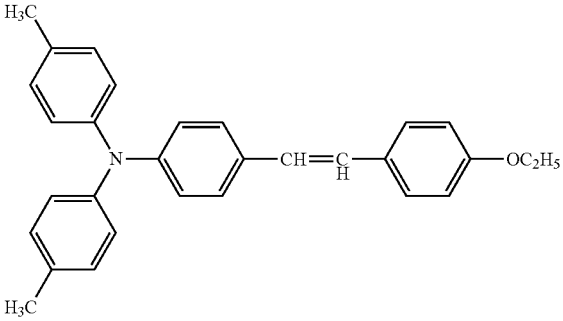

(A-6)

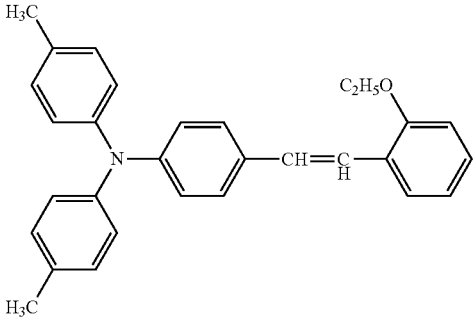

(A-7)

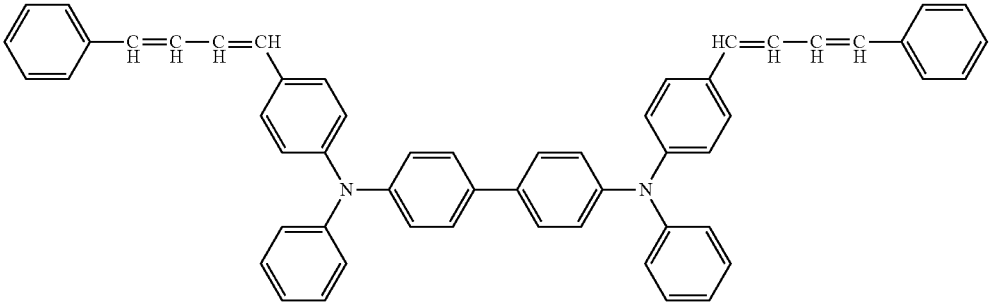

-continued (A-8)

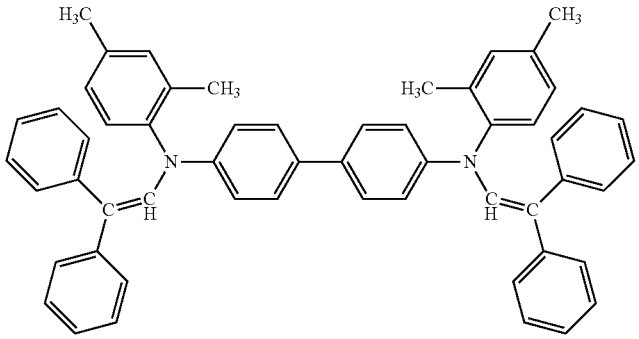

(A-9)

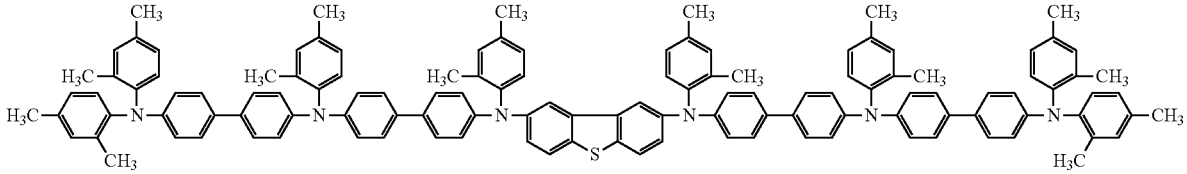

The above description of compound α applies to (α').

Resin β

Resin β is a binding resin, and examples thereof include polyester resin, acrylic resin, polyvinylcarbazole resin, phenoxy resin, polycarbonate resin, polyvinyl butyral resin, polystyrene resin, polyvinyl acetate resin, polysulfone resin, polyacrylate resin, vinylidene chlorideacrylonitrile copolymer, and poly(vinyl benzal) resin. These binding resins may be used singly, or may be combined to be used as a mixture or a copolymer.

If a polycarbonate resin is used as the binding resin, a polycarbonate resin having a repeating structural unit expressed by the following general formula (C) is advantageous. If a polyester resin is used as the binding resin, a polyester resin having the repeating structural unit expressed by the following general formula (D) is advantageous.

(C)

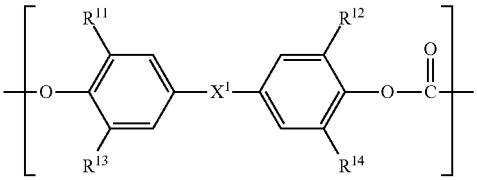

(D)

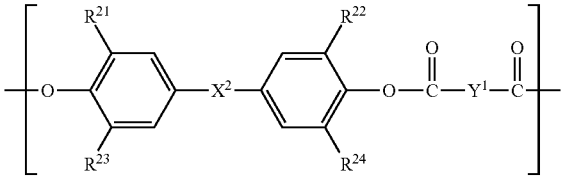

In general formula (C), $R_{11}$ to $R_{14}$ each represent hydrogen or methyl. $X_1$ represents a single bond, cyclohexylidene, or a divalent group expressed by general formula (E) below. In formula (D), $R_{21}$ to $R_{24}$ each represent hydrogen or methyl. $X_2$ represents a single bond, cyclohexylidene, or a divalent group expressed by general formula (E) below. $Y_1$ represents m-phenylene, p-phenylene, or a divalent group formed by binding two p-phenylene groups with an oxygen atom.

In general formula (E), $R_{31}$ and $R_{32}$ each represent hydrogen, methyl, or phenyl. Examples of the repeating structural units of the polycarbonate resin expressed by general formula (C) are as follows:

(C-1)

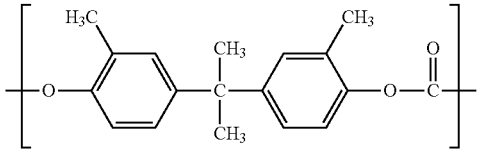

(C-2)

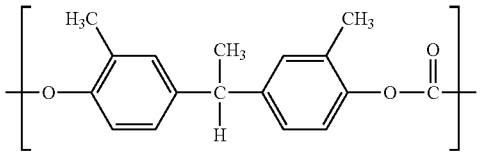

(C-3)

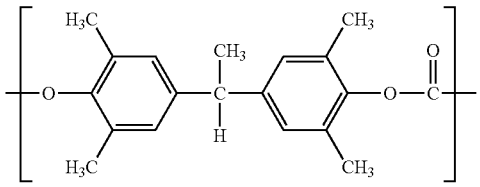

(C-4)

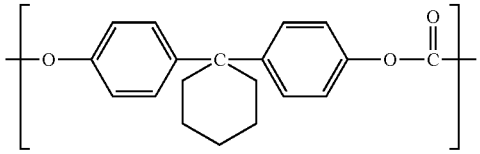

-continued (C-5)

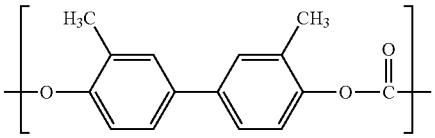

(C-6)

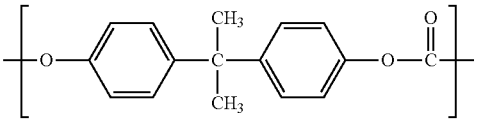

(C-7)

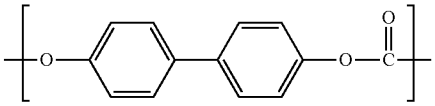

-continued (C-8)

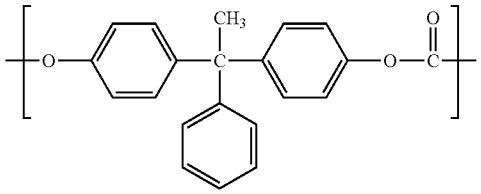

The polycarbonate resin may be a homopolymer of any one of the repeating structural units (C-1) to (C-8), or a copolymer of any two or more of these repeating structural units. Repeating structural units (C-1), (C-2) and (C-4) are more advantageous.

Examples of the repeating structural units of the polyester resin expressed by formula (D) are as follows:

(D-1)

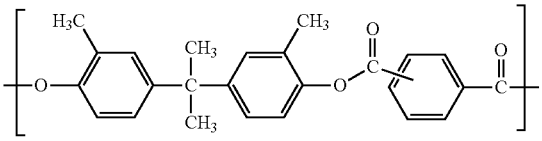

(D-2)

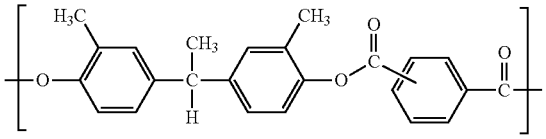

(D-3)

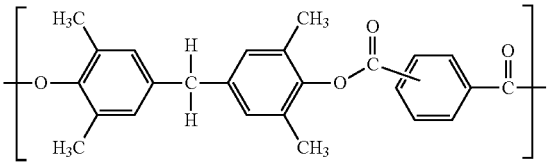

(D-4)

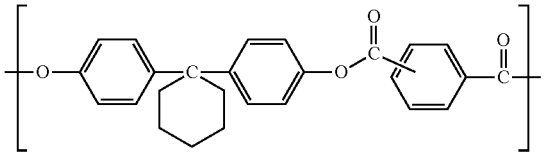

(D-5)

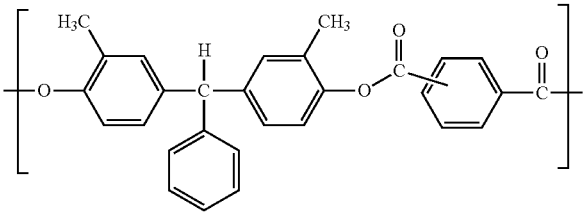

(D-6)

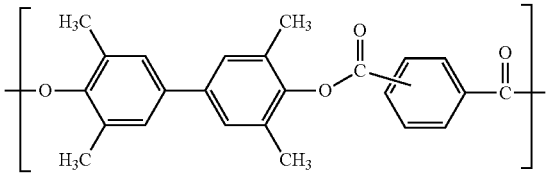

(D-7)

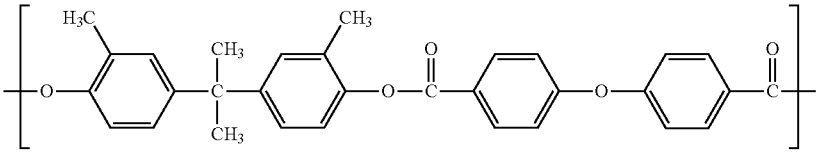

(D-8)

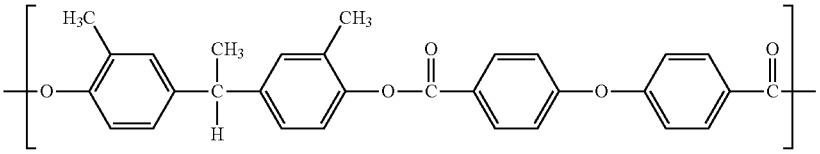

-continued (D-9)

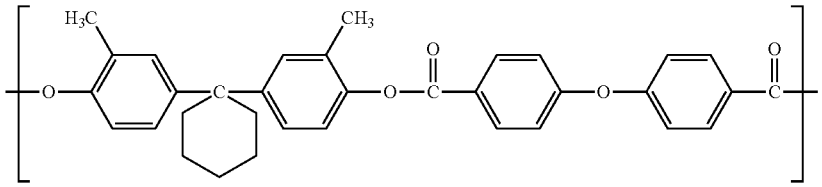

The polyester resin may be a homopolymer of any one of the repeating structural units (D-1) to (D-9), or a copolymer of any two or more of these repeating structural units. Repeating structural units (D-1), (D-2), (D-3), (D-6), (D-7) and (D-8) are more advantageous.

The polycarbonate resin and the polyester resin can be synthesized by, for example, a known phosgene process. The synthesis may be performed by transesterification.

If the polycarbonate or polyester resin is a copolymer, it may be in any form, such as block copolymer, random copolymer, or alternating copolymer.

The polycarbonate or polyester resin may have a weight average molecular weight in the range of 20000 to 300000, such as 50000 to 250000. The weight average molecular weight mentioned herein refers to the polystyrene equivalent weight average molecular weight measured by the method disclosed in Japanese Patent Laid-Open No. 2007-79555.

The polycarbonate resin or polyester resin as resin ϵ may be a copolymer having a repeating structure including a siloxane structure in addition to the repeating structural unit expressed by formula (C) or (D). For example, such a structural unit may be expressed by the following formula (F-1) or (F-2). Resin β may have the repeating structural unit expressed by formula (F-3).

(F-1)

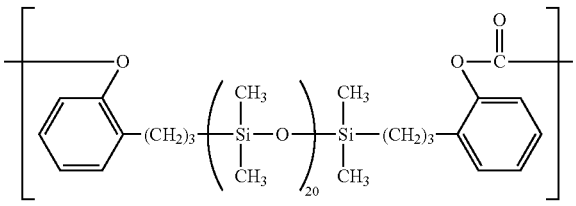

(F-2)

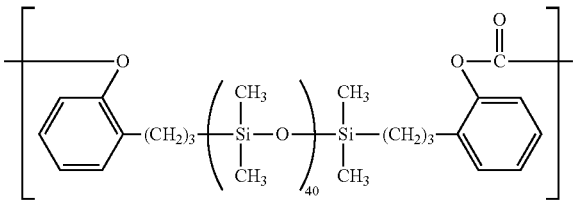

(F-3)

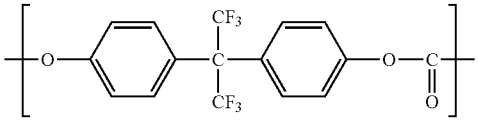

The binding resin used in the charge transport layer is not limited to polycarbonate resin or polyester resin and may have the structure expressed by formula (G-1) shown below. Also, the binding resin may contain a resin having a siloxane structure synthesized by the process described below.

(G-1)

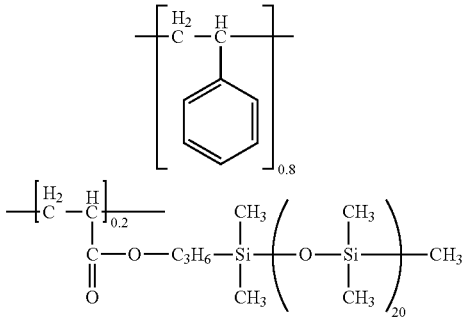

The above description of resin β applies to (β').

The charge transport layer may further contain an anti-oxidant, a UV absorbent, a plasticizer, silicone oil, or any other additives, if necessary.

Desirably, the proportion of resin β to compound α in the charge transport layer is in the range of 50% by mass to 200% by mass. When this proportion is less than 50% by mass, the photosensitive member exhibits low durability; and when the proportion is 200% or more, the photosensitive member exhibits low sensitivity.

If the charge transport layer is composed of a single layer, the thickness of the charge transport layer is desirably in the range of 5 μm to 40 μm, more desirably in the range of 6 μm to 40 μm, such as in the range of 8 μm to 35 μm. If the charge transport layer has a multilayer structure, the thickness of the charge transport layer closer to the support member is desirably in the range of 5 μm to 30 μm, such as in the range of 6 μm to 30 μm. In this instance, the thickness of the charge transport layer at the surface side of the multilayer structure is desirably in the range of 1 μm to 10 μm, such as in the range of 6 μm to 10 μm.

Compound γ

Compound γ is at least one of xylene and toluene. Xylene may be o-xylene, m-xylene, p-xylene, or a mixture of these isomers. In the embodiments of the present disclosure, any xylene may be used. o-Xylene is however advantageous.

In order to produce a satisfactory effect, the content of compound γ in the charge transport layer is in the range of 0.01% by mass to 2.00% by mass, desirably in the range of 0.01% by mass to 1.5% by mass, relative to the total mass of the charge transport layer. More desirably, compound γ contains 50% by mass to 100% by mass of xylene.

Compound δ

In order to produce a satisfactory effect, the content of compound δ in the charge transport layer is in the range of 0.01% by mass to 1.20% by mass relative to the total mass of the charge transport layer. Desirably, compound δ may contain at least one of cyclopentanone and cyclohexanone. More desirably, compound 5 contains 50% by mass to 100% by mass of cyclopentanone, and the proportion of compound δ in the charge transport layer is in the range of 0.01% by mass to 0.80% by mass relative to the total mass of the charge transfer layer.

Contents of Compounds γ and δ

As described above, compounds γ and δ with specific contents in the charge transport layer enable a more highly sensitive electrophotographic photosensitive member to be provided. The photosensitive member may have two or more charge transport layers. In this instance, it is advantageous that at least one of the charge transport layers contains compounds γ and δ with the above contents, and the thickness of this charge transport layer account for 60% or more of the total thickness of the charge transport layers. Desirably, the percentage of compound γ to compound δ in this charge transport layer ((content of compound γ/content of compound δ)×100) is in the range of 200% by mass to 9000% by mass. In this percentage, the hole transportability of the charge transport material is enhanced, and a satisfactory effect can be produced.

The contents of compounds γ and δ in the charge transport layer can be measured by the following method using a quadrupole GC/MS system TRACE ISQ (manufactured by Thermo Fisher Scientific).

An electrophotographic photosensitive member is cut into a 5 mm×40 mm test piece. The test piece is placed in a vial. TurboMatrix HS 40 Headspace Sampler (manufactured by Perkin Elmer) is set to the conditions: 200° C. in Oven, 205° C. in Loop, and 205° C. in Transfer Line. The gas generated from the test piece is measured by gas chromatography, and the amounts of compounds γ and δ in the charge transport layer are determined from a calibration curve.

The mass of the charge transfer layer is calculated from the difference in mass between the test piece taken out the vial and the test piece from which the charge transport layer has been removed. The contents of compounds γ and δ relative to the total mass of the charge transport layer are calculated from the mass of the charge transport layer and the measured amounts of compounds γ and δ.

The test piece from which the charge transport layer has been removed can be prepared by immersing the test piece taken out of the vial in methyl ethyl ketone for 5 minutes to remove the charge transport layer, and then drying the rest of the test piece at 50° C. for 5 minutes.

Contents of Compounds (α) and (β')

The contents of (α) and (β') can be appropriately determined according to the desired properties of the electrophotographic photosensitive member. In order to produce a satisfactory effect, the sum of (α) and (β') desirably accounts for 13% by to 25% by mass of the total mass of the charge transport layer forming coating liquid.

Compound (γ')

Compound (γ') is at least one of xylene and toluene. In order to produce a satisfactory effect, the proportion of (γ') is in the range of 15% by mass to 50% by mass, desirably in the range of 15% by mass to 47% by mass, relative to the total mass of (γ') and (δ'). Although compound (γ') may be either xylene or toluene or a mixture thereof, it is advantageous that xylene accounts for 50% by mass to 100% by mass of the total mass of (γ').

Compound (δ')

Compound (δ') is cyclopentanone. In order to produce a satisfactory effect, the proportion of (δ') is in the range of 50% by mass to 85% by mass, desirably in the range of 53% by mass to 85% by mass, relative to the total mass of (γ') and (δ').

Compound (ε)

The charge transport layer forming coating liquid may further contain a compound (ε) having a vapor pressure of 15 kPa or more at 20° C. The content of compound (ε) may be appropriately determined according to the desired properties of the resulting photosensitive member, the stability of the coating liquid, and the solubility. From the viewpoint of producing a satisfactory effect, the proportion to the total mass of compounds (γ') and (δ') is important, and it is advantageous that the total mass of compounds (γ') and (δ') be in the range of 40% by mass to 90% by mass relative to the total mass of compounds (γ'), (δ'), and (ε).

Dimethoxymethane is advantageous as compound (ε) in view of the fluidity of the coating liquid.

Although the method for preparing the charge transport layer forming coating liquid is not particularly limited, it is desirable in terms of storage stability that the method includes performing filtration at least after the coating liquid has been prepared. The filtration removes substances acting as nucleuses of aggregation, thus helping the resulting coating liquid produce a satisfactory effect.

Structure of Electrophotographic Photosensitive Member

The structure of the electrophotographic photosensitive member of the present disclosure will now be described.

The electrophotographic photosensitive member disclosed herein includes a support member, and a charge generating layer and a charge transport layer that are disposed over the support member. In other words, a multilayer (function-separated) photosensitive layer is defined by the charge generating layer and the charge transport layer. The multilayer photosensitive layer is desirably of a forward type including the charge generating layer and the charge transport layer in that order from the direction of the support member. The charge generating layer may have a multilayer structure, and the charge transport layer may have a multilayer structure.

The support member is desirably electrically conductive (electroconductive support member). The material of the support member may be iron, copper, gold, silver, aluminum, or zinc. Alternatively, the support member may be made of an alloy of some metals of titanium, lead, nickel, tin, antimony, indium, chromium and aluminum, or stainless steel (alloy). There may be used a metal or plastic support member coated with a film formed of, for example, aluminum, aluminum alloy or indium oxide-tin oxide alloy by vacuum deposition.

The support member may be a plastic or paper sheet impregnated with electrically conductive particles, such as carbon black, tin oxide particles, titanium oxide particles, or silver particles, or a member made of an electrically conductive binding resin sheet.

The surface of the support member may be cut, roughened or anodize so as to suppress interference fringes caused by scattering of a laser beam.

In order to suppress such interference fringes or to cover flaws in the support member, an electroconductive layer may be formed between the support member and an undercoat layer described later. The electroconductive layer may be formed by applying onto a surface a coating liquid for forming the electroconductive layer prepared by dispersing carbon black, an electrically conductive pigment, a resistance-adjusting pigment and a binding resin in a solvent, and drying the coating film. The coating liquid for the electroconductive layer may contain a compound capable of being cured by, for example, heating or exposure to UV light or radiation.

Examples of the binding resin used in the electroconductive layer include acrylic resin, allyl resin, alkyd resin, ethyl cellulose resin, ethylene-acrylic acid copolymer, epoxy resin, casein resin, silicone resin, gelatin resin, phenol resin, butyral resin, polyacrylate resin, polyacetal resin, polyamide-imide resin, polyamide resin, polyallyl ether resin, polyimide resin, polyurethane resin, polyester resin, polycarbonate resin, and polyethylene resin.

Examples of the electrically conductive pigment or the resistance-adjusting pigment include metal (alloy) particles, such as those of aluminum, zinc, copper, chromium, nickel, silver, and stainless steel, and plastic particles coated with any one of these metals. Metal oxide particles may be used, such as those of zinc oxide, titanium oxide, tin oxide, antimony oxide, indium oxide, bismuth oxide, tin-doped indium oxide, or antimony- or tantalum-doped tin oxide.

These pigments may be used singly or in combination. The electrically conductive pigment and the resistance-adjusting pigment may be surface-treated. Exemplary surface treatment agents include a surfactant, a silane coupling agent, and a titanium coupling agent.

In order to reduce light scattering, silicone resin fine particles or acrylic resin fine particles may be added. In addition, the electroconductive layer may further contain other additives, such as a leveling agent, a dispersant, an antioxidant, an ultraviolet absorbent, a plasticizer, and a rectifying material.

The thickness of the electroconductive layer may be in the range of 0.2 μm to 40 μm, such as 1 μm to 35 μm or 5 μm to 30 μm.

An undercoat layer (intermediate layer) may be provided between the support member or the electroconductive layer and the photosensitive layer (charge generating layer, charge transport layer) so as to improve the adhesion of the photosensitive layer and improve the injection of charges from the support member. The undercoat layer may be formed by applying an undercoat liquid prepared by mixing a binding resin and a solvent and drying the coating film of the undercoat liquid.

Examples of the binding resin used in the undercoat layer include polyvinyl alcohol, polyethylene oxide, ethyl cellulose, methyl cellulose, casein, polyamide (nylon 6, nylon 66, nylon 610, copolymerized nylon, and Nalkoxymethylated nylon), polyurethane resin, acrylic resin, allyl resin, alkyd resin, phenol resin, and epoxy resin.

The undercoat layer may have a thickness in the range of 0.05 μm to 40 μm. The undercoat layer may further contain metal oxide particles. The metal oxide particles used in the undercoat layer desirably contain particles of at least one metal oxide selected from the group consisting of titanium oxide, zinc oxide, tin oxide, zirconium oxide, and aluminum oxide. Particles containing zinc oxide are advantageous.

The metal oxide particles may be surface-treated with a surface treatment agent, such as a silane coupling agent. The materials can be dispersed using, for example, a homogenizer, an ultrasonic disperser, a ball mill, a sand mill, a roll mill, a vibration mill, an attritor, or a highspeed liquid collision disperser.

The undercoat layer may further contain organic resin particles or a leveling agent so as to, for example, control the surface roughness thereof or reduce cracks therein. The organic resin particles may be hydrophobic organic particles, such as silicone particles, or hydrophilic organic particles, such as cross-linked poly(methacrylate) resin (PMMA) particles.

The undercoat layer may contain other additives, such as a metal, an electrically conductive material, an electron transporting material, a metal chelate compound, and a silane coupling agent or any other organic compounds.

The charge generating layer may be formed by applying a coating liquid for the charge generating layer prepared by dispersing a charge generation material and a binding resin in a solvent, and drying the coating film of the coating liquid. Alternatively, the charge generating layer may be a deposition film formed by depositing a charge generating material.

Examples of the charge generating material include azo pigments, phthalocyanine pigments, indigo pigments, perylene pigments, polycyclic quinone pigments, squarylium dyes, thiapyrylium salts, triphenylmethane dyes, quinacridone pigments, azulenium salt pigments, cyanine dyes, anthanthrone pigments, pyranthrone pigments, xanthene dyes, quinonimine dyes, and styryl dyes.

These charge generating materials may be used singly or in combination. From the viewpoint of sensitivity, oxytitanium phthalocyanine, chlorogallium phthalocyanine, and hydroxygallium phthalocyanine are advantageous. Crystalline hydroxygallium phthalocyanine whose CuKβ X-ray diffraction spectrum shows peaks at Bragg angle 2θ of 7.4°±0.3° and 28.2°±0.3° is more advantageous.

Examples of the binding resin used in the charge generating layer include polycarbonate resin, polyester resin, butyral resin, polyvinyl acetal resin, acrylic resin, vinyl acetate resin, and urea resin. Among these, butyral resin is advantageous. These binding resins may be used singly, or may be combined to be used as a mixture or a copolymer.

The materials can be dispersed using, for example, a homogenizer, an ultrasonic disperser, a ball mill, a sand mill, a roll mill, or an attritor.

The proportion of the charge generating material in the charge generating layer is desirably in the range of 0.3 parts by mass to 10 parts by mass relative to 1 part by mass of the binding resin. The charge generating layer may further contain a sensitizer, a leveling agent, a dispersant, an antioxidant, a UV absorbent, a plasticizer, and a rectifying material, if necessary. The thickness of the charge generating layer is desirably in the range of 0.01 μm to 5 μm, such as in the range of 0.1 μm to 2 μm.

The charge transport layer is disposed on the charge generating layer. The charge transport layer may be formed by applying a coating liquid for the charge transport layer prepared by dispersing a charge transport material and a binding resin in a solvent, and drying the coating film of the coating liquid.

Examples of the charge transport material include pyrene compounds, N-alkyl carbazole compounds, N,N-dialkylaniline compounds, diphenylamine compounds, triphenylamine compounds, triphenylmethane compounds, pyrazoline compounds, and butadiene compounds, in addition to the above-cited compounds, such as triarylamine compounds, hydrazone compounds, and styryl compounds. These charge transport materials may be used singly or in combination. From the viewpoint of preventing cracks in the charge transport layer, compounds having the above-described partial structure expressed by general formula (A) are advantageous. More advantageously, the charge transport material contains any of the compounds expressed by formulas (A-1) to (A-9).

The binding resin used in the charge transport layer, that is, resin β, may be a polycarbonate resin (resin A) having a repeating structural unit expressed by general formula (C) or a polyester resin (resin B) having a repeating structural unit expressed by general formula (D). These binding resins may be used together with acrylic resin, polyvinylcarbazole resin, phenoxy resin, polyvinyl butyral resin, polystyrene resin, polyvinyl acetate resin, polysulfone resin, vinylidene chloride-acrylonitrile copolymer, and poly(vinyl benzal) resin.

These binding resins may be used singly, or may be combined to be used as a mixture or a copolymer.

The solvent used in the coating liquid for the charge transport layer may be an alcohol-based solvent, a sulfoxide-based solvent, a ketone-based solvent, an ether-based solvent, an ester-based solvent, or an aromatic hydrocarbon.

The charge transport layer may further contain an antidegradant, a UV absorbent, a plasticizer, a leveling agent, organic fine particles, or inorganic fine particles, if necessary.

Examples of the antidegradant include a hindered phenol-based antioxidant, a hindered amine-based light stabilizer, a sulfur-containing antioxidant, and a phosphorus-containing antioxidant.

The organic fine particles may be fluorine-containing organic resin fine particles, polystyrene fine particles, polyethylene resin particles, or any other polymer resin particles. The inorganic fine particles may be particles of silica or metal oxide such as alumina.

The charge transport layer may be covered with a protective layer so as to increase the abrasion resistance and cleanability of the electrophotographic photosensitive member. The protective layer may be formed by applying a coating liquid for the protective layer prepared by dissolving a binding resin in a solvent, and drying the coating film of the coating liquid.

Examples of the binding resin used in the protective layer include polyvinyl butyral resin, polyester resin, polycarbonate resin, polyamide resin, polyimide resin, polyurethane resin, and phenol resin.

Alternatively, the protective layer may be formed by applying a coating solution for the protective layer prepared by dissolving a polymerizable monomer or oligomer in a solvent, and curing the coating film of the coating solution by a crosslinking reaction or a polymerization reaction. The polymerizable monomer or oligomer may be a compound having a chain-polymerizable functional group, such as acryloyloxy or styryl, or a compound having a sequentially polymerizable functional group, such as hydroxy, alkoxysilyl, isocyanate, or epoxy.

Examples of the reaction for curing the protective layer include radical polymerization, ionic polymerization, thermal polymerization, photopolymerization, radiation-induced polymerization (electron beam polymerization), plasma CVD, and optical CVD.

The protective layer may further contain electrically conductive particles or charge transport material. The electrically conductive particles may be the same as those used in the electroconductive layer. The charge transport material may be the same as that used in the charge transport layer.

From the viewpoint of abrasion resistance and charge transportability, a charge transport material having a polymerizable functional group is advantageously used. The polymerizable functional group may be acryloyloxy. A charge transport material having two or more polymerizable functional group in the molecule is advantageous.

The surface layer (the charge transport layer or the protective layer) of the electrophotographic photosensitive member may contain organic resin particles or inorganic particles. The organic resin particles may be fluorine-containing organic resin fine particles or acrylic resin particles. The inorganic particles may be those of alumina, silica or titania. Furthermore, the surface layer may contain electrically conductive particles, an antioxidant, a UV absorbent, a plasticizer, a leveling agent, or the like.

The thickness of the protective layer may be in the range of 0.1 μm to 30 μm, such as in the range of 1 μm to 10 μm.

The coating liquid for each layer may be applied by dip coating, spray coating, spinner coating, roller coating, mayer bar coating, blade coating, or any other coating technique.

Process Cartridge and Electrophotographic Apparatus

FIGURE schematically shows the structure of an electrophotographic apparatus provided with a process cartridge including an electrophotographic photosensitive member. This electrophotographic photosensitive member 1, which is cylindrical, is driven for rotation on a in the direction indicated by an arrow at a predetermined peripheral speed (process speed). The surface of the electrophotographic photosensitive member 1 driven for rotation is uniformly charged to a predetermined positive or negative potential with a charging device 3 (primary charging device such as charging roller). Subsequently, an electrostatic latent image corresponding to desired image information is formed on the surface of the charged electrophotographic photosensitive member 1 by irradiation with exposure light (light for exposing images) 4 from an exposure device (image exposing device, not shown). The exposure light 4 has been intensity-modulated according to the time-series electric digital image signals of desired image information output from an image exposure device for, for example, slit exposure or laser beam scanning exposure.

The electrostatic latent image formed on the surface of the electrophotographic photosensitive member 1 is developed (normally developed or reversely developed) into a toner image with a developer (toner) contained in a developing device 5. The toner image on the surface of the electrophotographic photosensitive member 1 is transferred to a transfer medium P by a transfer bias from a transfer device 6, such as a transfer roller. At this time, the transfer medium. P is fed to an abutting portion between the electrophotographic photosensitive member 1 and the transfer device 6 from a transfer medium feeder (not shown) in synchronization with the rotation of the electrophotographic photosensitive member 1. Also, a bias voltage having an opposite polarity to the charge of the toner is applied to the transfer device from a bias source (not shown).

The transfer medium P to which the toner image has been transferred is separated from the surface of the electrophotographic photosensitive member 1 and transferred to a fixing device 8 for fixing the toner image, thus being ejected as an image-formed article (printed matter or copy).

The surface of the electrophotographic photosensitive member 1 from which the toner image has been transferred is cleaned with a cleaning device 7 to remove therefrom the developer (toner) or the like remaining after transfer.

Some of the components of the electrophotographic apparatus including the electrophotographic photosensitive member 1, the charging device 3, the developing device 5, and the cleaning device 7 may be integrated in a container as a process cartridge. The process cartridge may be removably mounted to the body of an electrophotographic apparatus. For example, the electrophotographic photosensitive member 1 and at least one selected from among the charging device 3, the developing device 5 and the cleaning device 7 are integrated into a cartridge.

If the electrophotographic apparatus is a copy machine or a printer, the exposure light 4 may be reflected light from or transmitted light through an original image. Alternatively, the exposure may be performed by laser beam scanning according to the signals generated by reading the original image with a sensor, or performed with light emitted by driving an LED array or a liquid crystal shutter array.

EXAMPLES

The present disclosure will be further described in detail with reference to specific examples. The term "part(s)" used hereinafter refers to "part(s) by mass".

Synthesis of Siloxane Resin

In 10% sodium hydroxide aqueous solution was dissolved 12.0 g of the diol expressed by formula (h-1) shown below. Dichloromethane was added to the resulting solution, followed by stirring, and 15 g of phosgene was blown into the solution over 1 hour while the solution was kept at a temperature in the range of 10° C. to 15° C. When about 70% of phosgene had been blown, 4.2 g of the siloxane derivative expressed by formula (h-2) and 4.0 g of the diol expressed by formula (h-3) were added to the solution. After the completion of introducing phosgene, the reaction liquid was violently stirred for emulsification. Then, triethylamine was added, and the mixture was stirred for 1 hour. Then, the dichloromethane phase was neutralized with phosphoric acid and further rinsed with water until the pH came to about 7. Subsequently, the resulting liquid phase was dropped into isopropyl alcohol, and the precipitate was collected by filtration and dried to yield a white polymer (resin A3).

The resulting resin A3 had a weight average molecular weight of 20,000.

(h-1)

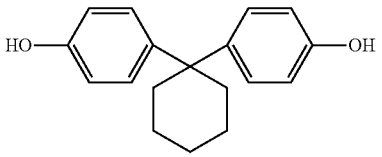

(h-2)

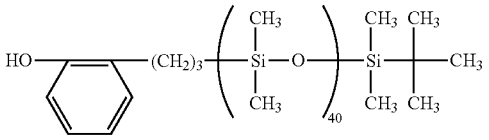

(h-3)

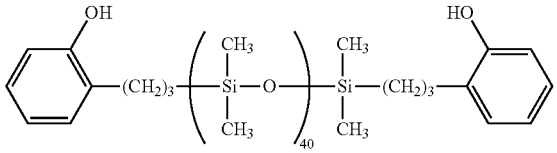

Table 1 shows resins used as resin β or β'.

TABLE 1

| Resin β (Resin β') (Polycarbonate resin A, Polyester resin B, Other resin C) | Repeating structural unit | Proportion of repeating structural units (in terms of mass) | Weight average molecular weight (Mw) |
|---|---|---|---|
| Resin A1 | C-4 | — | 55000 |
| Resin A2 | C-4/F-1/F-3 | 6/1.5/2.5 | 60000 |
| Resin A3 | — | — | 20000 |
| Resin B1 | D-8 | — | 100000 |
| Resin B2 | D-1/D-6 | 7/3 | 120000 |
| Resin B3 | D-1 | — | 120000 |
| Resin B4 | D-1/D-6 | 7/3 | 180000 |
| Resin B5 | D-1 | — | 180000 |
| Resin B6 | D-1/D-7 | 3/7 | 120000 |
| Resin C1 | G-1 | — | — |

Preparation of Electrophotographic Photosensitive Member

Preparation of Photosensitive Member A-1

An aluminum cylinder of 30 mm in diameter and 357.5 mm in length was used as a support member (cylindrical support member).

Then, in a ball mill were dispersed 60 parts of tin oxide-coated barium sulfate particles (PASTRAN PC1, produced by "Mitsui Mining & Smelting), 15 parts of tin oxide particles (TITANIX JR, produced by Tayca), 43 parts of resol-type phenol resin (PHENOLITE J-325, produced by DIC, solid content: 70% by mass), 0.015 part of silicone oil (SH28PA, produced by Toray Silicone), 3.6 parts of silicone resin particles (TOSPEARL 120, produced by Toray Silicone), 50 parts of 2-methoxy-1-propanol, and 50 parts of methanol for 20 hours to yield a coating liquid for the electroconductive layer. This coating liquid was applied to the surface of the support member by dip coating. The resulting coating film was dried and cured by heating at 140° C. for 1 hour to yield a 15 μm thick electroconductive layer.

Subsequently, 10 parts of copolymerized nylon (Amilan CM8000, produced by Toray) and 30 parts of methoxymethylated 6-nylon resin (Tresin EF-30T, produced by Teikoku Chemical) were dissolved in a mixed solution of 400 parts of methanol and 200 parts of n-butanol to yield a coating liquid for forming an undercoat layer. This coating liquid was applied to the surface of the electroconductive layer by dip coating. The resulting coating film was dried at 100° C. for 30 minutes to yield a 0.45 μm thick undercoat layer.

Subsequently, a sand mill containing glass bead of 1 mm in diameter was charged with 20 parts of a crystalline hydroxygallium phthalocyanine (charge generating material) whose CuKβ X-ray diffraction spectrum has strong peaks at Bragg angles 2θ of 7.4°±0.2° and 28.2°±0.2°, 0.2 part of a calixarene compound expressed by the following formula (1), 10 parts of a polyvinyl butyral (S-LEC BX-1, produced by Sekisui Chemical) and 600 parts of cyclohexanone.

(1)

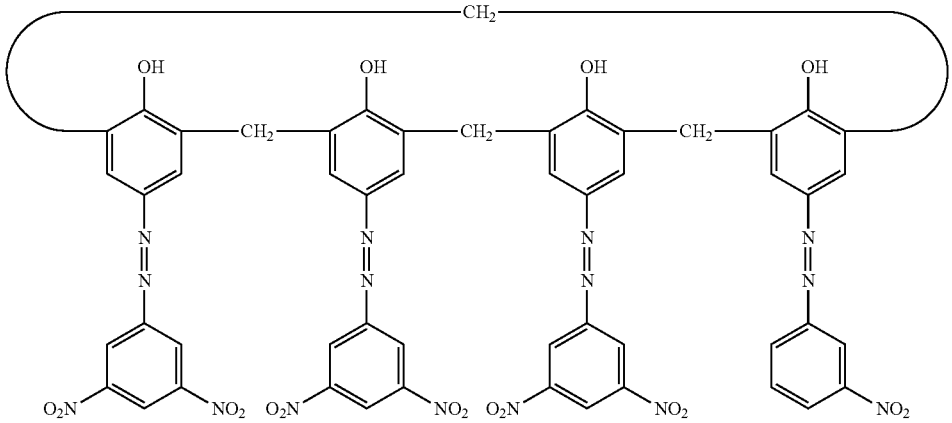

After the materials were dispersed in each other for 4 hours, 700 parts of ethyl acetate was added to the dispersion to yield a coating liquid for forming a charge generating layer. The coating liquid for the charge generating layer was applied to the surface of the undercoat layer by dip coating. The resulting coating film was dried at 80° C. for 15 minutes to yield a 0.17 μm thick charge generating layer.

Subsequently, a coating liquid for a charge transport layer was prepared by mixing:

7.2 parts of the compound expressed by formula (A-1) (charge transporting compound or hole transporting compound);

0.8 part of the compound expressed by formula (A-2) (charge transporting compound or hole transporting compound);

10 parts of resin B1;

16 parts of o-xylene;

28 parts of cyclopentanone; and 36 parts of dimethoxymethane (methylal).

The coating liquid for the charge transport layer was applied to a surface of the charge generating layer by dip coating. The resulting coating film was dried at 120° C. for 60 minutes to yield a 30 μm thick charge transport layer.

Thus, an electrophotographic photosensitive member having a charge transport layer as the surface layer was completed. The resulting electrophotographic photosensitive member was cut into a test piece with the above-mentioned dimensions, and the test piece was subjected to gas chromatography for determination of the contents of o-xylene (compound γ) and cyclopentanone (compound δ). The o-xylene (compound γ) content was 1.2% by mass, and the cyclopentanone (compound δ) content was 0.11% by mass. Details of the electrophotographic photosensitive member are shown in Table 2. The resulting electrophotographic photosensitive member was evaluated as photosensitive member A-1.

Preparation of Photosensitive Members A-2 to A-35

Electrophotographic photosensitive members were prepared in the same process as photosensitive member A-1, except that the contents of resin β and compound γ were varied according to Table 2 and that the drying temperature and drying time were set as shown in Table 3. Details are shown in Tables 2 and 3. The resulting electrophotographic photosensitive members were evaluated as photosensitive members A-2 to A-35, respectively.

Preparation of Photosensitive Members A-101 to A-110

Electrophotographic photosensitive members were prepared in the same process as photosensitive member A-1, except that the contents of resin β and compound γ were varied according to Table 4 and that the drying temperature and drying time were set as shown in Table 5. Details are shown in Tables 4 and 5. The resulting electrophotographic photosensitive members were evaluated as photosensitive members A-101 to A-110, respectively.

Preparation of Photosensitive Members B-1 to B-30

Electrophotographic photosensitive members were prepared in the same process as photosensitive member A-1, except that the contents of compound α, resin β and compounds γ and δ were varied according to Table 6 and that the drying temperature and drying time were set as shown in Table 7. Details are shown in Tables 6 and 7. The resulting electrophotographic photosensitive members were evaluated as photosensitive members B-1 to B-30, respectively.

Preparation of Photosensitive Members B-101 to B-110

Electrophotographic photosensitive members were prepared in the same process as photosensitive member A-1, except that the contents of compound α, resin β and compounds γ and δ were varied according to Table 8 and that the drying temperature and drying time were set as shown in Table 9. Details are shown in Tables 8 and 9. The resulting electrophotographic photosensitive members were evaluated as photosensitive members B-101 to B-110, respectively.

Preparation of Photosensitive Members C-1 to C-30

Electrophotographic photosensitive members were prepared in the same process as photosensitive member A-1, except that the contents of compound α, resin β and compounds γ and δ were varied according to Table 10 and that the drying temperature and drying time were set as shown in Table 11. Details are shown in Tables 10 and 11. The resulting electrophotographic photosensitive members were evaluated as photosensitive members C-1 to C-30, respectively.

Preparation of Photosensitive Members C-101 to C-110

Electrophotographic photosensitive members were prepared in the same process as photosensitive member A-1, except that the contents of compound α, resin β and compounds γ and δ were varied according to Table 12 and that the drying temperature and drying time were set as shown in Table 13. Details are shown in Tables 12 and 13. The resulting electrophotographic photosensitive members were evaluated as photosensitive members C-101 to C-110, respectively.

Preparation of Photosensitive Members D-1 to D-9

Electrophotographic photosensitive members were prepared in the same process as photosensitive member A-1, except that the charge transport layer was formed to a thickness of 20 μm with the composition in which compound α and the content thereof, resin β and the content thereof, and the contents of compounds γ and δ were varied according to Table 14, and that the drying temperature and drying time were set as shown in Table 15. Details are shown in Tables 14 and 15. The resulting electrophotographic photosensitive members were evaluated as photosensitive members D-1 to D-9, respectively.

Preparation of Photosensitive Members D-101 to D-109

Electrophotographic photosensitive members were prepared in the same process as photosensitive member A-1, except that the charge transport layer was formed to a thickness of 20 μm with the composition in which compound α and the content thereof, resin β and the content thereof, and the contents of compounds γ and δ were varied according to Table 16, and that the drying temperature and drying time were set as shown in Table 17. Details are shown in Tables 16 and 17. The resulting electrophotographic photosensitive members were evaluated as photosensitive members D-101 to D-109, respectively.

Preparation of Photosensitive Member D-110

The layers up to the charge generating layer were formed in the same manner as in the process of photosensitive member A-1.

Then, a coating liquid for a charge transport layer was prepared by mixing the following materials:

10 parts of the compound expressed by the following formula (Z-1) (charge transporting compound or hole transporting compound);

10 parts of resin A1; and 100 parts of tetrahydrofuran.

The coating liquid for the charge transport layer was applied to a surface of the charge generating layer by dip coating. The resulting coating film was dried at 135° C. for 20 minutes to yield a 22 μm thick charge transport layer.

Then, a coating liquid for a second charge transport layer was prepared by mixing the following materials:

3 parts of alumina (AA03, produced by Sumitomo Chemical, average primary particle size: 0.3 μm);

0.06 part of unsaturated carboxylic acid polymer (BYK-P104, produced by BYK);

4 parts of the compound expressed by formula (A-3) (charge transporting compound or hole transporting compound);

10 parts of resin A1;

10 parts of o-xylene;

220 parts of tetrahydrofuran; and 70 parts of cyclopentanone.

The coating liquid for the charge transport layer was applied to a surface of the charge generating layer by spray coating. The resulting coating film was dried at 135° C. for 20 minutes to yield a 5 μm thick second charge transport layer. The resulting electrophotographic photosensitive member was evaluated as photosensitive member D-110.

Part of the second charge transport layer was cut out and placed in a vial. TurboMatrix HS 40 Headspace Sample (manufactured by Perkin Elmer) was set to the conditions: 200° C. in Oven, 205° C. in Loop, and 205° C. in Transfer Line, and the gas generated from the test piece was subjected to gas chromatography. The amounts of compounds γ and δ in the charge transport layer were determined from a calibration curve. The mass of the charge transport layer was calculated from the difference between the total mass of the vial after the measurement and the test piece of the charge transport layer and the mass of the vial measured in advance. The contents of compounds γ and δ were 0.006% and 0.004%, respectively. The percentage of the compound γ content to the compound δ content was 150% by mass.

Preparation of Photosensitive Member D-111

The layers up to the charge generating layer were formed in the same manner as in the process of photosensitive member A-1.

A coating liquid for a charge transport layer was prepared by mixing the following materials:

10 parts of the compound expressed by the following formula (Z-1) (charge transporting compound or hole transporting compound);

10 parts of resin A1; and 100 parts of tetrahydrofuran.

The coating liquid for the charge transport layer was applied to a surface of the charge generating layer by dip coating. The resulting coating film was dried at 135° C. for 20 minutes to yield a 22 μm thick charge transport layer.

A coating liquid for a second charge transport layer was prepared by mixing the following materials:

3 parts of alumina (AA03, produced by Sumitomo Chemical, average primary particle size: 0.3 μm);

0.06 part of unsaturated carboxylic acid polymer (BYK-P104, produced by BYK);

4 parts of the compound expressed by formula (Z-2) (charge transporting compound or hole transporting compound), 10 parts of resin A1;

10 parts of o-xylene;

220 parts of tetrahydrofuran; and 70 parts of cyclopentanone.

The coating liquid for the charge transport layer was applied to a surface of the charge generating layer by spray coating. The resulting coating film was dried at 135° C. for 20 minutes to yield a 5 μm thick second charge transport layer.

The resulting electrophotographic photosensitive member was evaluated as photosensitive member D-111. The contents of compounds γ and δ were determined in the same manner as those in photosensitive member D-110. The contents of compounds γ and δ were 0.006% and 0.004%, respectively. The percentage of the compound γ content to the compound δ content was 150% by mass.

(Z-1)

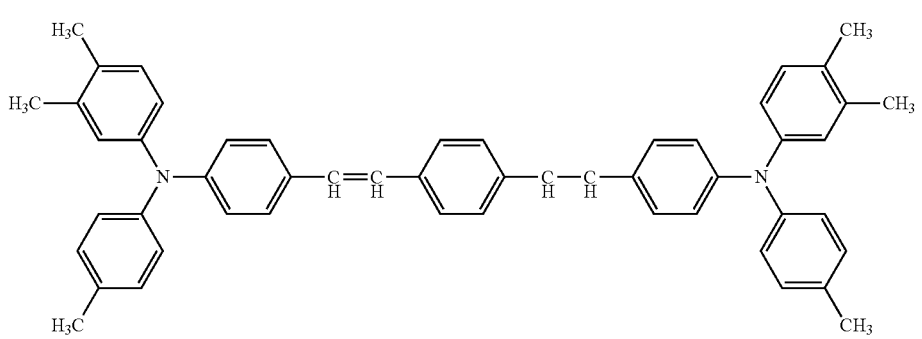

-continued (Z-2)

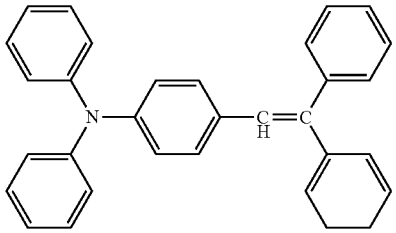

Preparation of Photosensitive Members E-1 to E-9

Electrophotographic photosensitive members were prepared in the same process as photosensitive member A-1, except that the charge transport layer was formed to a thickness of 20 μm with the composition in which compound α and the content thereof, resin β and the content thereof, and the contents of compounds γ and δ were varied according to Table 18, and that the drying temperature and drying time were set as shown in Table 19. Details are shown in Tables 18 and 19. The resulting electrophotographic photosensitive members were evaluated as photosensitive members E-1 to E-9, respectively.

Preparation of Photosensitive Members E-101 to E-109

Electrophotographic photosensitive members were prepared in the same process as photosensitive member A-1, except that the charge transport layer was formed to a thickness of 20 μm with the composition in which compound α and the content thereof, resin β and the content thereof, and the contents of compounds γ and δ were varied according to Table 20, and that the drying temperature and drying time were set as shown in Table 21. Details are shown in Tables 20 and 21. The resulting electrophotographic photosensitive members were evaluated as photosensitive members E-101 to E-109, respectively.

Preparation of Photosensitive Members F-1 to F-7

Electrophotographic photosensitive members were prepared in the same process as photosensitive member A-1, except that the charge transport layer was formed to a thickness of 20 μm with the composition in which compound α and the content thereof, resin β and the content thereof, the content of compounds γ, and compound δ and the content thereof were varied according to Table 22, and that the drying temperature and drying time were set as shown in Table 23. Details are shown in Tables 22 and 23. The resulting electrophotographic photosensitive members were evaluated as photosensitive members F-1 to F-7, respectively.

Preparation of Photosensitive Members F-101 to F-109

Electrophotographic photosensitive members were prepared in the same process as photosensitive member A-1, except that the charge transport layer was formed to a thickness of 20 μm with the composition in which compound α and the content thereof, resin β and the content thereof, the content of compounds γ, and compound δ and the content thereof were varied according to Table 24, and that the drying temperature and drying time were set as shown in Table 25. Details are shown in Tables 24 and 25. The resulting electrophotographic photosensitive members were evaluated as photosensitive members F-101 to F-109, respectively.

Preparation of Photosensitive Member G-1

An electrophotographic photosensitive member was prepared in the same process as photosensitive member A-1, except that the charge transport layer was formed to a thickness of 20 μm with the composition in which compound α and the content thereof, resin β and the content thereof, compound γ and the content thereof, and compound δ and the content thereof were varied according to Table 26, and that the drying temperature and drying time were set as shown in Table 27. Details are shown in Tables 26 and 27. The resulting electrophotographic photosensitive member was evaluated as photosensitive member G-1.

Preparation of Photosensitive Member G-101

An electrophotographic photosensitive member was prepared in the same process as photosensitive member A-1, except that the charge transport layer was formed to a thickness of 20 μm with the composition in which compound α and the content thereof, resin β and the content thereof, compound γ and the content thereof, and compound δ and the content thereof were varied according to Table 28, and that the drying temperature and drying time were set as shown in Table 29. Details are shown in Tables 28 and 29. The resulting electrophotographic photosensitive member was evaluated as photosensitive member G-101. "Xylene" in the following Tables represents "o-xylene".

TABLE 2

| | α | | β | | ((β) content/ | γ | | δ | | Another solvent | |
|---|---|---|---|---|---|---|---|---|---|---|---|
| | Compound | Parts by mass | Resin β | Parts by mass | (α) content) × 100 | Compound | Parts by mass | Compound | Parts by mass | Compound | Parts by mass |
| Photosensitive member A-1 | A-1/A-2 | 7.2/0.8 | Resin B2 | 10 | 125 | Xylene | 16 | Cyclopentanone | 28 | Methylal | 36 |
| Photosensitive member A-2 | A-1/A-2 | 7.2/0.8 | Resin B2 | 10 | 125 | Xylene | 21 | Cyclopentanone | 23 | Methylal | 36 |
| Photosensitive member A-3 | A-1/A-2 | 7.2/0.8 | Resin B2 | 10 | 125 | Xylene | 16 | Cyclopentanone | 30 | Methylal | 36 |
| Photosensitive member A-4 | A-1/A-2 | 7.2/0.8 | Resin B2 | 10 | 125 | Xylene | 21 | Cyclopentanone | 25 | Methylal | 36 |

TABLE 2-continued

| | α | | β | | ((β) content/ | γ | | δ | | Another solvent | |
|---|---|---|---|---|---|---|---|---|---|---|---|
| | Compound | Parts by mass | Resin β | Parts by mass | (α) content) × 100 | Compound | Parts by mass | Compound | Parts by mass | Compound | Parts by mass |
| Photosensitive member A-5 | A-1/A-2 | 7.2/0.8 | Resin B2 | 10 | 125 | Xylene | 8 | Cyclopentanone | 38 | Methylal | 36 |
| Photosensitive member A-6 | A-1/A-2 | 7.2/0.8 | Resin B2 | 10 | 125 | Xylene | 14 | Cyclopentanone | 38 | Methylal | 36 |
| Photosensitive member A-7 | A-1/A-2 | 7.2/0.8 | Resin B2 | 10 | 125 | Xylene | 41 | Cyclopentanone | 5 | Methylal | 36 |
| Photosensitive member A-8 | A-1/A-2 | 7.2/0.8 | Resin B2 | 10 | 125 | Xylene | 41 | Cyclopentanone | 5 | Methylal | 36 |
| Photosensitive member A-9 | A-1/A-2 | 7.2/0.8 | Resin B2 | 10 | 125 | Xylene | 33 | Cyclopentanone | 13 | Methylal | 36 |
| Photosensitive member A-10 | A-1/A-2 | 7.2/0.8 | Resin B2 | 10 | 125 | Xylene | 21 | Cyclopentanone | 23 | Methylal | 36 |
| Photosensitive member A-11 | A-1/A-2 | 7.2/0.8 | Resin B2 | 10 | 125 | Xylene | 16 | Cyclopentanone | 28 | Methylal | 36 |
| Photosensitive member A-12 | A-1/A-2 | 7.2/0.8 | Resin B2 | 10 | 125 | Xylene | 41 | Cyclopentanone | 20 | Methylal | 36 |
| Photosensitive member A-13 | A-1/A-2 | 7.2/0.8 | Resin B2 | 10 | 125 | Xylene | 16 | Cyclopentanone | 30 | Methylal | 36 |
| Photosensitive member A-14 | A-1/A-2 | 7.2/0.8 | Resin B2 | 10 | 125 | Xylene | 2 | Cyclopentanone | 40 | Methylal | 36 |
| Photosensitive member A-15 | A-1/A-2 | 7.2/0.8 | Resin B2 | 10 | 125 | Xylene | 41 | Cyclopentanone | 35 | Methylal | 36 |
| Photosensitive member A-16 | A-1/A-2 | 7.2/0.8 | Resin B2 | 10 | 125 | Xylene | 16 | Cyclopentanone | 38 | Methylal | 36 |
| Photosensitive member A-17 | A-1/A-2 | 7.2/0.8 | Resin B2 | 10 | 125 | Xylene | 2 | Cyclopentanone | 43 | Methylal | 36 |
| Photosensitive member A-18 | A-1/A-2 | 7.2/0.8 | Resin B2 | 10 | 125 | Xylene | 41 | Cyclopentanone | 38 | Methylal | 36 |
| Photosensitive member A-19 | A-1/A-2 | 7.2/0.8 | Resin B2 | 10 | 125 | Xylene | 16 | Cyclopentanone | 50 | Methylal | 36 |
| Photosensitive member A-20 | A-1/A-2 | 7.2/0.8 | Resin B2 | 10 | 125 | Xylene | 2 | Cyclopentanone | 46 | Methylal | 36 |
| Photosensitive member A-21 | A-1/A-2 | 7.2/0.8 | Resin B2 | 10 | 125 | Xylene | 21 | Cyclopentanone | 23 | Methylal | 36 |

TABLE 3

| | Drying temperature [° C.] | Drying time [min] | CTL thickness [μm] | γ Content [%] | δ Content [%] | Percentage of γ content to δ content |
|---|---|---|---|---|---|---|
| Photosensitive member A-1 | 120 | 60 | 30 | 1.20 | 0.11 | 1091 |
| Photosensitive member A-2 | 120 | 60 | 30 | 1.40 | 0.12 | 1167 |
| Photosensitive member A-3 | 120 | 60 | 30 | 0.95 | 0.14 | 667 |
| Photosensitive member A-4 | 120 | 60 | 30 | 1.48 | 0.15 | 987 |
| Photosensitive member A-5 | 120 | 60 | 30 | 0.92 | 0.40 | 230 |
| Photosensitive member A-6 | 120 | 60 | 30 | 1.42 | 0.38 | 375 |
| Photosensitive member A-7 | 120 | 60 | 30 | 1.98 | 0.01 | 20900 |
| Photosensitive member A-8 | 125 | 60 | 30 | 1.50 | 0.01 | 15833 |
| Photosensitive member A-9 | 125 | 60 | 30 | 0.95 | 0.01 | 10000 |
| Photosensitive member A-10 | 125 | 60 | 30 | 0.81 | 0.01 | 8550 |
| Photosensitive member A-11 | 130 | 120 | 30 | 0.01 | 0.01 | 100 |
| Photosensitive member A-12 | 120 | 60 | 30 | 2.00 | 0.05 | 4222 |
| Photosensitive member A-13 | 125 | 60 | 30 | 0.47 | 0.05 | 1000 |
| Photosensitive member A-14 | 120 | 60 | 30 | 0.01 | 0.05 | 20 |
| Photosensitive member A-15 | 120 | 60 | 30 | 1.97 | 0.15 | 1313 |
| Photosensitive member A-16 | 125 | 60 | 30 | 0.40 | 0.18 | 222 |
| Photosensitive member A-17 | 120 | 60 | 30 | 0.01 | 0.14 | 7 |
| Photosensitive member A-18 | 120 | 60 | 30 | 1.95 | 0.38 | 515 |
| Photosensitive member A-19 | 125 | 60 | 30 | 0.47 | 0.42 | 113 |
| Photosensitive member A-20 | 120 | 60 | 30 | 0.01 | 0.46 | 2 |
| Photosensitive member A-21 | 115 | 60 | 30 | 1.79 | 0.79 | 227 |
| Photosensitive member A-22 | 115 | 60 | 30 | 1.40 | 0.71 | 197 |
| Photosensitive member A-23 | 115 | 60 | 30 | 0.95 | 0.75 | 126 |
| Photosensitive member A-24 | 115 | 60 | 30 | 0.47 | 0.70 | 68 |
| Photosensitive member A-25 | 115 | 60 | 30 | 0.01 | 0.74 | 1 |
| Photosensitive member A-26 | 115 | 60 | 30 | 1.92 | 1.18 | 162 |
| Photosensitive member A-27 | 115 | 60 | 30 | 1.42 | 1.20 | 118 |
| Photosensitive member A-28 | 115 | 60 | 30 | 0.95 | 1.15 | 82 |
| Photosensitive member A-29 | 115 | 60 | 30 | 0.47 | 1.16 | 41 |

TABLE 3-continued

| | Drying temperature [° C.] | Drying time [min] | CTL thickness [μm] | γ Content [%] | δ Content [%] | Percentage of γ content to δ content |
|---|---|---|---|---|---|---|
| Photosensitive member A-30 | 115 | 60 | 30 | 0.01 | 1.18 | 1 |
| Photosensitive member A-31 | 120 | 60 | 30 | 1.11 | 0.10 | 1110 |
| Photosensitive member A-32 | 120 | 60 | 30 | 1.16 | 0.07 | 1657 |
| Photosensitive member A-33 | 120 | 60 | 30 | 1.01 | 0.12 | 842 |
| Photosensitive member A-34 | 120 | 60 | 30 | 1.05 | 0.30 | 350 |
| Photosensitive member A-35 | 120 | 60 | 30 | 1.31 | 0.23 | 570 |

TABLE 4

| | α | | β | | ((β) content/ | γ | | δ | | Another solvent | |
|---|---|---|---|---|---|---|---|---|---|---|---|
| | Compound | Parts by mass | Resin β | Parts by mass | (α) content) × 100 | Compound | Parts by mass | Compound | Parts by mass | Compound | Parts by mass |
| Photosensitive member A-101 | A-1/A-2 | 7.2/0.8 | Resin B2 | 10 | 125 | Xylene | 16 | Cyclopentanone | 28 | Methylal | 36 |
| Photosensitive member A-102 | A-1/A-2 | 7.2/0.8 | Resin B2 | 10 | 125 | Xylene | 46 | Cyclopentanone | 0 | Methylal | 36 |
| Photosensitive member A-103 | A-1/A-2 | 7.2/0.8 | Resin B2 | 10 | 125 | Xylene | 46 | Cyclopentanone | 0 | Methylal | 36 |
| Photosensitive member A-104 | A-1/A-2 | 7.2/0.8 | Resin B2 | 10 | 125 | Xylene | 46 | Cyclopentanone | 0 | Methylal | 36 |
| Photosensitive member A-105 | A-1/A-2 | 7.2/0.8 | Resin B2 | 10 | 125 | Xylene | 0 | Cyclopentanone | 46 | Methylal | 36 |
| Photosensitive member A-106 | A-1/A-2 | 7.2/0.8 | Resin B2 | 10 | 125 | Xylene | 0 | Cyclopentanone | 46 | Methylal | 36 |
| Photosensitive member A-107 | A-1/A-2 | 7.2/0.8 | Resin B2 | 10 | 125 | Xylene | 21 | Cyclopentanone | 23 | Methylal | 36 |
| Photosensitive member A-108 | A-1/A-2 | 7.2/0.8 | Resin B2 | 10 | 125 | Xylene | 21 | Cyclopentanone | 35 | Methylal | 36 |
| Photosensitive member A-109 | A- 1/A-2 | 7.2/0.8 | Resin B2 | 10 | 125 | Xylene | 15 | Cyclopentanone | 35 | Methylal | 36 |
| Photosensitive member A-110 | A-1/A-2 | 7.2/0.8 | Resin B2 | 10 | 125 | Xylene | 21 | Cyclopentanone | 35 | Methylal | 36 |

TABLE 5

| | Drying temperature [° C.] | Drying time [min] | CTL thickness [μm] | γ Content [%] | δ Content [%] | Percentage of γ content to δ content |
|---|---|---|---|---|---|---|
| Photosensitive member A-101 | 130 | 130 | 30 | 0 | 0 | — |
| Photosensitive member A-102 | 125 | 60 | 30 | 0.88 | 0 | — |
| Photosensitive member A-103 | 120 | 90 | 30 | 1.81 | 0 | — |
| Photosensitive member A-104 | 120 | 60 | 30 | 2.43 | 0 | — |
| Photosensitive member A-105 | 125 | 60 | 30 | 0 | 0.16 | 0 |
| Photosensitive member A-106 | 120 | 60 | 30 | 0 | 1.5 | 0 |
| Photosensitive member A-107 | 115 | 45 | 30 | 2.55 | 0.14 | 1821 |
| Photosensitive member A-108 | 115 | 60 | 30 | 2.68 | 1.61 | 166 |
| Photosensitive member A-109 | 115 | 60 | 30 | 0.92 | 1.53 | 60 |
| Photosensitive member A-110 | 115 | 60 | 30 | 2.25 | 1.55 | 145 |

TABLE 6

| | α | | β | | ((β) content/ | γ | | δ | | Another solvent | |
|---|---|---|---|---|---|---|---|---|---|---|---|
| | Compound | Parts by mass | Resin β | Parts by mass | (α) content) × 100 | Compound | Parts by mass | Compound | Parts by mass | Compound | Parts by mass |
| Photosensitive member B-1 | A-1/A-2 | 5.4/0.6 | Resin B2 | 12 | 200 | Xylene | 16 | Cyclopentanone | 28 | Methylal | 36 |
| Photosensitive member B-2 | A-1/A-2 | 5.4/0.6 | Resin B2 | 12 | 200 | Xylene | 21 | Cyclopentanone | 23 | Methylal | 36 |
| Photosensitive member B-3 | A-1/A-2 | 5.4/0.6 | Resin B2 | 12 | 200 | Xylene | 16 | Cyclopentanone | 30 | Methylal | 36 |

TABLE 6-continued

| | α | | β | | ((β) content/ | γ | | δ | | Another solvent | |
|---|---|---|---|---|---|---|---|---|---|---|---|
| | Compound | Parts by mass | Resin β | Parts by mass | (α) content) × 100 | Compound | Parts by mass | Compound | Parts by mass | Compound | Parts by mass |
| Photosensitive member B-4 | A-1/A-2 | 5.4/0.6 | Resin B2 | 12 | 200 | Xylene | 21 | Cyclopentanone | 25 | Methylal | 36 |
| Photosensitive member B-5 | A-1/A-2 | 5.4/0.6 | Resin B2 | 12 | 200 | Xylene | 8 | Cyclopentanone | 38 | Methylal | 36 |
| Photosensitive member B-6 | A-1/A-2 | 5.4/0.6 | Resin B2 | 12 | 200 | Xylene | 14 | Cyclopentanone | 38 | Methylal | 36 |
| Photosensitive member B-7 | A-1/A-2 | 5.4/0.6 | Resin B2 | 12 | 200 | Xylene | 41 | Cyclopentanone | 5 | Methylal | 36 |
| Photosensitive member B-8 | A-1/A-2 | 5.4/0.6 | Resin B2 | 12 | 200 | Xylene | 41 | Cyclopentanone | 5 | Methylal | 36 |
| Photosensitive member B-9 | A-1/A-2 | 5.4/0.6 | Resin B2 | 12 | 200 | Xylene | 33 | Cyclopentanone | 13 | Methylal | 36 |
| Photosensitive member B-10 | A-1/A-2 | 5.4/0.6 | Resin B2 | 12 | 200 | Xylene | 21 | Cyclopentanone | 23 | Methylal | 36 |
| Photosensitive member B-11 | A-1/A-2 | 5.4/0.6 | Resin B2 | 12 | 200 | Xylene | 16 | Cyclopentanone | 28 | Methylal | 36 |
| Photosensitive member B-12 | A-1/A-2 | 5.4/0.6 | Resin B2 | 12 | 200 | Xylene | 41 | Cyclopentanone | 20 | Methylal | 36 |
| Photosensitive member B-13 | A-1/A-2 | 5.4/0.6 | Resin B2 | 12 | 200 | Xylene | 16 | Cyclopentanone | 30 | Methylal | 36 |
| Photosensitive member B-14 | A-1/A-2 | 5.4/0.6 | Resin B2 | 12 | 200 | Xylene | 2 | Cyclopentanone | 40 | Methylal | 36 |
| Photosensitive member B-15 | A-1/A-2 | 5.4/0.6 | Resin B2 | 12 | 200 | Xylene | 41 | Cyclopentanone | 35 | Methylal | 36 |
| Photosensitive member B-16 | A-1/A-2 | 5.4/0.6 | Resin B2 | 12 | 200 | Xylene | 16 | Cyclopentanone | 38 | Methylal | 36 |
| Photosensitive member B-17 | A-1/A-2 | 5.4/0.6 | Resin B2 | 12 | 200 | Xylene | 2 | Cyclopentanone | 43 | Methylal | 36 |
| Photosensitive member B-18 | A-1/A-2 | 5.4/0.6 | Resin B2 | 12 | 200 | Xylene | 41 | Cyclopentanone | 38 | Methylal | 36 |
| Photosensitive member B-19 | A-1/A-2 | 5.4/0.6 | Resin B2 | 12 | 200 | Xylene | 16 | Cyclopentanone | 80 | Methylal | 36 |
| Photosensitive member B-20 | A-1/A-2 | 5.4/0.6 | Resin B2 | 12 | 200 | Xylene | 2 | Cyclopentanone | 46 | Methylal | 36 |
| Photosensitive member B-21 | A-1/A-2 | 5.4/0.6 | Resin B2 | 12 | 200 | Xylene | 21 | Cyclopentanone | 23 | Methylal | 36 |

TABLE 7

| | Drying temperature [° C.] | Drying time [min] | CTL thickness [μm] | γ Content [%] | δ Content [%] | Percentage of γ content to δ content |
|---|---|---|---|---|---|---|
| Photosensitive member B-1 | 120 | 60 | 30 | 1.01 | 0.15 | 673 |
| Photosensitive member B-2 | 120 | 60 | 30 | 1.32 | 0.10 | 1320 |
| Photosensitive member B-3 | 120 | 60 | 30 | 0.85 | 0.16 | 531 |
| Photosensitive member B-4 | 120 | 60 | 30 | 1.42 | 0.33 | 430 |
| Photosensitive member B-5 | 120 | 60 | 30 | 0.98 | 0.35 | 280 |
| Photosensitive member B-6 | 120 | 60 | 30 | 1.41 | 0.49 | 288 |
| Photosensitive member B-7 | 120 | 60 | 30 | 1.88 | 0.01 | 19844 |
| Photosensitive member B-8 | 125 | 60 | 30 | 1.43 | 0.01 | 15094 |
| Photosensitive member B-9 | 125 | 60 | 30 | 1.12 | 0.01 | 11822 |
| Photosensitive member B-10 | 125 | 60 | 30 | 0.73 | 0.01 | 7706 |
| Photosensitive member B-11 | 130 | 120 | 30 | 0.01 | 0.01 | 100 |
| Photosensitive member B-12 | 120 | 60 | 30 | 1.91 | 0.04 | 4775 |
| Photosensitive member B-13 | 125 | 60 | 30 | 0.59 | 0.05 | 1246 |
| Photosensitive member B-14 | 120 | 60 | 30 | 0.01 | 0.05 | 20 |
| Photosensitive member B-15 | 120 | 60 | 30 | 1.96 | 0.18 | 1089 |
| Photosensitive member B-16 | 125 | 60 | 30 | 0.31 | 0.12 | 258 |
| Photosensitive member B-17 | 120 | 60 | 30 | 0.01 | 0.13 | 7 |
| Photosensitive member B-18 | 120 | 60 | 30 | 1.92 | 0.38 | 505 |
| Photosensitive member B-19 | 125 | 60 | 30 | 0.53 | 0.48 | 110 |
| Photosensitive member B-20 | 120 | 60 | 30 | 0.01 | 0.45 | 2 |
| Photosensitive member B-21 | 115 | 60 | 30 | 1.88 | 0.71 | 265 |
| Photosensitive member B-22 | 115 | 60 | 30 | 1.49 | 0.79 | 189 |
| Photosensitive member B-23 | 115 | 60 | 30 | 1.01 | 0.76 | 133 |
| Photosensitive member B-24 | 115 | 60 | 30 | 0.50 | 0.72 | 69 |
| Photosensitive member B-25 | 115 | 60 | 30 | 0.01 | 0.78 | 1 |
| Photosensitive member B-26 | 115 | 60 | 30 | 1.89 | 1.14 | 166 |
| Photosensitive member B-27 | 115 | 60 | 30 | 1.46 | 1.16 | 126 |

TABLE 7-continued

| | Drying temperature [° C.] | Drying time [min] | CTL thickness [μm] | γ Content [%] | δ Content [%] | Percentage of γ content to δ content |
|---|---|---|---|---|---|---|
| Photosensitive member B-28 | 115 | 60 | 30 | 1.12 | 1.16 | 97 |
| Photosensitive member B-29 | 115 | 60 | 30 | 0.49 | 1.19 | 41 |
| Photosensitive member B-30 | 115 | 60 | 30 | 0.01 | 1.10 | 1 |

TABLE 8

| | α | | β | | ((β) content/ | γ | | δ | | Another solvent | |
|---|---|---|---|---|---|---|---|---|---|---|---|
| | Compound | Parts by mass | Resin β | Parts by mass | (α) content) × 100 | Compound | Parts by mass | Compound | Parts by mass | Compound | Parts by mass |
| Photosensitive member B-101 | A-1/A-2 | 5.4/0.6 | Resin B2 | 12 | 200 | Xylene | 16 | Cyclopentanone | 28 | Methylal | 36 |
| Photosensitive member B-102 | A-1/A-2 | 5.4/0.6 | Resin B2 | 12 | 200 | Xylene | 46 | Cyclopentanone | 0 | Methylal | 36 |
| Photosensitive member B-103 | A-1/A-2 | 5.4/0.6 | Resin B2 | 12 | 200 | Xylene | 46 | Cyclopentanone | 0 | Methylal | 36 |
| Photosensitive member B-104 | A-1/A-2 | 5.4/0.6 | Resin B2 | 12 | 200 | Xylene | 46 | Cyclopentanone | 0 | Methylal | 36 |
| Photosensitive member B-105 | A-1/A-2 | 5.4/0.6 | Resin B2 | 12 | 200 | Xylene | 0 | Cyclopentanone | 46 | Methylal | 36 |
| Photosensitive member B-106 | A-1/A-2 | 5.4/0.6 | Resin B2 | 12 | 200 | Xylene | 0 | Cyclopentanone | 46 | Methylal | 36 |
| Photosensitive member B-107 | A-1/A-2 | 5.4/0.6 | Resin B2 | 12 | 200 | Xylene | 21 | Cyclopentanone | 23 | Methylal | 36 |
| Photosensitive member B-108 | A-1/A-2 | 5.4/0.6 | Resin B2 | 12 | 200 | Xylene | 21 | Cyclopentanone | 35 | Methylal | 36 |
| Photosensitive member B-109 | A-1/A-2 | 5.4/0.6 | Resin B2 | 12 | 200 | Xylene | 15 | Cyclopentanone | 35 | Methylal | 36 |
| Photosensitive member B-110 | A-1/A-2 | 5.4/0.6 | Resin B2 | 12 | 200 | Xylene | 21 | Cyclopentanone | 35 | Methylal | 36 |

TABLE 9

| | Drying temperature [° C.] | Drying time [min] | CTL thickness [μm] | γ Content [%] | δ Content [%] | Percentage of γ content to δ content |
|---|---|---|---|---|---|---|
| Photosensitive member B-101 | 130 | 130 | 30 | 0 | 0 | — |
| Photosensitive member B-102 | 125 | 60 | 30 | 0.79 | 0 | — |
| Photosensitive member B-103 | 120 | 90 | 30 | 1.91 | 0 | — |
| Photosensitive member B-104 | 120 | 60 | 30 | 2.6 | 0 | — |
| Photosensitive member B-105 | 125 | 60 | 30 | 0 | 0.14 | 0 |
| Photosensitive member B-106 | 120 | 60 | 30 | 0 | 1.62 | 0 |
| Photosensitive member B-107 | 115 | 45 | 30 | 2.13 | 0.16 | 1331 |
| Photosensitive member B-108 | 115 | 60 | 30 | 2.54 | 1.65 | 154 |
| Photosensitive member B-109 | 115 | 60 | 30 | 0.82 | 1.47 | 56 |
| Photosensitive member B-110 | 115 | 60 | 30 | 2.3 | 1.61 | 143 |

TABLE 10

| | α | | β | | ((β) content/ | γ | | δ | | Another solvent | |
|---|---|---|---|---|---|---|---|---|---|---|---|
| | Compound | Parts by mass | Resin β | Parts by mass | (α) content) × 100 | Compound | Parts by mass | Compound | Parts by mass | Compound | Parts by mass |
| Photosensitive member C-1 | A-1/A-2 | 11/1 | Resin B2 | 6 | 50 | Xylene | 16 | Cyclopentanone | 28 | Methylal | 36 |
| Photosensitive member C-2 | A-1/A-2 | 11/1 | Resin B2 | 6 | 50 | Xylene | 21 | Cyclopentanone | 23 | Methylal | 36 |
| Photosensitive member C-3 | A-1/A-2 | 11/1 | Resin B2 | 6 | 50 | Xylene | 16 | Cyclopentanone | 30 | Methylal | 36 |
| Photosensitive member C-4 | A-1/A-2 | 11/1 | Resin B2 | 6 | 50 | Xylene | 21 | Cyclopentanone | 25 | Methylal | 36 |

TABLE 10-continued

| | α | | β | | ((β) content/ | γ | | δ | | Another solvent | |
|---|---|---|---|---|---|---|---|---|---|---|---|
| | Compound | Parts by mass | Resin β | Parts by mass | (α) content) × 100 | Compound | Parts by mass | Compound | Parts by mass | Compound | Parts by mass |
| Photosensitive member C-5 | A-1/A-2 | 11/1 | Resin B2 | 6 | 50 | Xylene | 8 | Cyclopentanone | 38 | Methylal | 36 |
| Photosensitive member C-6 | A-1/A-2 | 11/1 | Resin B2 | 6 | 50 | Xylene | 14 | Cyclopentanone | 38 | Methylal | 36 |
| Photosensitive member C-7 | A-1/A-2 | 11/1 | Resin B2 | 6 | 50 | Xylene | 41 | Cyclopentanone | 5 | Methylal | 36 |
| Photosensitive member C-8 | A-1/A-2 | 11/1 | Resin B2 | 6 | 50 | Xylene | 41 | Cyclopentanone | 5 | Methylal | 36 |
| Photosensitive member C-9 | A-1/A-2 | 11/1 | Resin B2 | 6 | 50 | Xylene | 33 | Cyclopentanone | 13 | Methylal | 36 |
| Photosensitive member C-10 | A-1/A-2 | 11/1 | Resin B2 | 6 | 50 | Xylene | 21 | Cyclopentanone | 23 | Methylal | 36 |
| Photosensitive member C-11 | A-1/A-2 | 11/1 | Resin B2 | 6 | 50 | Xylene | 16 | Cyclopentanone | 28 | Methylal | 36 |
| Photosensitive member C-12 | A-1/A-2 | 11/1 | Resin B2 | 6 | 50 | Xylene | 41 | Cyclopentanone | 20 | Methylal | 36 |
| Photosensitive member C-13 | A-1/A-2 | 11/1 | Resin B2 | 6 | 50 | Xylene | 16 | Cyclopentanone | 30 | Methylal | 36 |
| Photosensitive member C-14 | A-1/A-2 | 11/1 | Resin B2 | 6 | 50 | Xylene | 2 | Cyclopentanone | 40 | Methylal | 36 |
| Photosensitive member C-15 | A-1/A-2 | 11/1 | Resin B2 | 6 | 50 | Xylene | 41 | Cyclopentanone | 35 | Methylal | 36 |
| Photosensitive member C-16 | A-1/A-2 | 11/1 | Resin B2 | 6 | 50 | Xylene | 16 | Cyclopentanone | 38 | Methylal | 36 |
| Photosensitive member C-17 | A-1/A-2 | 11/1 | Resin B2 | 6 | 50 | Xylene | 2 | Cyclopentanone | 43 | Methylal | 36 |
| Photosensitive member C-18 | A-1/A-2 | 11/1 | Resin B2 | 6 | 50 | Xylene | 41 | Cyclopentanone | 38 | Methylal | 36 |
| Photosensitive member C-19 | A-1/A-2 | 11/1 | Resin B2 | 6 | 50 | Xylene | 16 | Cyclopentanone | 50 | Methylal | 36 |
| Photosensitive member C-20 | A-1/A-2 | 11/1 | Resin B2 | 6 | 50 | Xylene | 2 | Cyclopentanone | 46 | Methylal | 36 |
| Photosensitive member C-21 | A-1/A-2 | 11/1 | Resin B2 | 6 | 50 | Xylene | 21 | Cyclopentanone | 23 | Methylal | 36 |

TABLE 11

| | Drying temperature [° C.] | Drying time [min] | CTL thickness [μm] | γ Content [%] | δ Content [%] | Percentage of γ content to δ content |
|---|---|---|---|---|---|---|
| Photosensitive member C-1 | 120 | 60 | 30 | 1.10 | 0.13 | 846 |
| Photosensitive member C-2 | 120 | 60 | 30 | 1.32 | 0.11 | 1200 |
| Photosensitive member C-3 | 120 | 60 | 30 | 1.01 | 0.15 | 673 |
| Photosensitive member C-4 | 120 | 60 | 30 | 1.45 | 0.12 | 1208 |
| Photosensitive member C-5 | 120 | 60 | 30 | 0.90 | 0.38 | 237 |
| Photosensitive member C-6 | 120 | 60 | 30 | 1.49 | 0.32 | 466 |
| Photosensitive member C-7 | 120 | 60 | 30 | 1.91 | 0.01 | 20161 |
| Photosensitive member C-8 | 125 | 60 | 30 | 1.32 | 0.01 | 13933 |
| Photosensitive member C-9 | 125 | 60 | 30 | 1.12 | 0.01 | 11822 |
| Photosensitive member C-10 | 125 | 60 | 30 | 0.73 | 0.01 | 7706 |
| Photosensitive member C-11 | 130 | 120 | 30 | 0.01 | 0.01 | 100 |
| Photosensitive member C-12 | 120 | 60 | 30 | 1.88 | 0.04 | 4700 |
| Photosensitive member C-13 | 125 | 60 | 30 | 0.50 | 0.05 | 1000 |
| Photosensitive member C-14 | 120 | 60 | 30 | 0.01 | 0.04 | 24 |
| Photosensitive member C-15 | 120 | 60 | 30 | 1.91 | 0.18 | 1061 |
| Photosensitive member C-16 | 125 | 60 | 30 | 0.35 | 0.15 | 233 |
| Photosensitive member C-17 | 120 | 60 | 30 | 0.01 | 0.12 | 8 |
| Photosensitive member C-18 | 120 | 60 | 30 | 1.80 | 0.44 | 409 |
| Photosensitive member C-19 | 125 | 60 | 30 | 0.53 | 0.48 | 110 |
| Photosensitive member C-20 | 120 | 60 | 30 | 0.01 | 0.32 | 3 |
| Photosensitive member C-21 | 115 | 60 | 30 | 1.99 | 0.74 | 269 |
| Photosensitive member C-22 | 115 | 60 | 30 | 1.49 | 0.79 | 189 |
| Photosensitive member C-23 | 115 | 60 | 30 | 0.82 | 0.71 | 115 |
| Photosensitive member C-24 | 115 | 60 | 30 | 0.52 | 0.76 | 68 |
| Photosensitive member C-25 | 115 | 60 | 30 | 0.01 | 0.79 | 1 |
| Photosensitive member C-26 | 115 | 60 | 30 | 1.84 | 1.10 | 167 |
| Photosensitive member C-27 | 115 | 60 | 30 | 1.44 | 1.24 | 116 |

TABLE 11-continued

| | Drying temperature [° C.] | Drying time [min] | CTL thickness [μm] | γ Content [%] | δ Content [%] | Percentage of γ content to δ content |
|---|---|---|---|---|---|---|
| Photosensitive member C-28 | 115 | 60 | 30 | 1.10 | 1.18 | 93 |
| Photosensitive member C-29 | 115 | 60 | 30 | 0.42 | 1.09 | 39 |
| Photosensitive member C-30 | 115 | 60 | 30 | 0.01 | 1.16 | 1 |

TABLE 12

| | α | | β | | ((β) content/ | γ | | δ | | Another solvent | |
|---|---|---|---|---|---|---|---|---|---|---|---|
| | Compound | Parts by mass | Resin β | Parts by mass | (α) content) × 100 | Compound | Parts by mass | Compound | Parts by mass | Compound | Parts by mass |
| Photosensitive member C-101 | A-1/ A-2 | 11/1 | Resin B2 | 6 | 50 | Xylene | 16 | Cyclopen-tanone | 28 | Methylal | 36 |
| Photosensitive member C-102 | A-1/ A-2 | 11/1 | Resin B2 | 6 | 50 | Xylene | 46 | Cyclopen-tanone | 0 | Methylal | 36 |
| Photosensitive member C-103 | A-1/ A-2 | 1/1 | Resin B2 | 6 | 50 | Xylene | 46 | Cyclopen-tanone | 0 | Methylal | 36 |
| Photosensitive member C-104 | A-1/ A-2 | 11/1 | Resin B2 | 6 | 50 | Xylene | 46 | Cyclopen-tanone | 0 | Methylal | 36 |
| Photosensitive member C-105 | A-1/ A-2 | 11/1 | Resin B2 | 6 | 50 | Xylene | 0 | Cyclopen-tanone | 46 | Methylal | 36 |
| Photosensitive member C-106 | A- 1/ A-2 | 11/1 | Resin B2 | 6 | 50 | Xylen e | 0 | Cyclopen-tanone | 46 | Methylal | 36 |
| Photosensitive member C-107 | A-1/ A-2 | 11/1 | Resin B2 | 6 | 50 | Xylene | 21 | Cyclope ntanone | 23 | Methylal | 36 |
| Photosensitive member C-108 | A-1/ A-2 | 11/1 | Resin B2 | 6 | 50 | Xylene | 21 | Cyclopen-tanone | 35 | Methylal | 36 |
| Photosensitive member C-109 | A- 1/ A-2 | 11/1 | Resin B2 | 6 | 50 | Xylene | 15 | Cyclopen-tanone | 35 | Methylal | 36 |
| Photosensitive member C-110 | A-1/ A-2 | 11/1 | Resin B2 | 6 | 50 | Xylene | 21 | Cyclopen-tanone | 35 | Methylal | 36 |

TABLE 13

| | Drying temperature [° C.] | Drying time [min] | CTL thickness [μm] | γ Content [%] | δ Content [%] | Percentage of γ content to δ content |
|---|---|---|---|---|---|---|
| Photosensitive member C-101 | 130 | 130 | 30 | 0 | 0 | — |
| Photosensitive member C-102 | 125 | 60 | 30 | 0.93 | 0 | — |
| Photosensitive member C-103 | 120 | 90 | 30 | 1.9 | 0 | — |
| Photosensitive member C-104 | 120 | 60 | 30 | 2.21 | 0 | — |
| Photosensitive member C-105 | 125 | 60 | 30 | 0 | 0.21 | 0 |
| Photosensitive member C-106 | 120 | 60 | 30 | 0 | 1.33 | 0 |
| Photosensitive member C-107 | 115 | 45 | 30 | 2.61 | 0.11 | 2373 |
| Photosensitive member C-108 | 115 | 60 | 30 | 2.5 | 1.58 | 158 |
| Photosensitive member C-109 | 115 | 60 | 30 | 0.88 | 1.6 | 55 |
| Photosensitive member C-110 | 115 | 60 | 30 | 2.3 | 1.63 | 141 |

TABLE 14

| | α | | β | | ((β) content/ | γ | | δ | | Another solvent | |
|---|---|---|---|---|---|---|---|---|---|---|---|
| | Compound | Parts by mass | Resin β | Parts by mass | (α) content) × 100 | Compound | Parts by mass | Compound | Parts by mass | Compound | Parts by mass |
| Photosensitive member D-1 | A-3 | 8 | Resin A1 | 10 | 125 | Xylene | 16 | Cyclopen-tanone | 28 | Methylal | 36 |
| Photosensitive member D-2 | A-3 | 8 | Resin A1 | 10 | 125 | Xylene | 21 | Cyclopen-tanone | 23 | Methylal | 36 |
| Photosensitive member D-3 | A-3 | 8 | Resin A1 | 10 | 125 | Xylene | 16 | Cyclopen-tanone | 30 | Methylal | 36 |
| Photosensitive member D-4 | A-3 | 8 | Resin A1 | 10 | 125 | Xylene | 21 | Cyclopen-tanone | 25 | Meth ylal | 36 |

TABLE 14-continued

| | α | | β | | ((β) content/ | γ | | δ | | Another solvent | |
|---|---|---|---|---|---|---|---|---|---|---|---|
| | Compound | Parts by mass | Resin β | Parts by mass | (α) content) × 100 | Compound | Parts by mass | Compound | Parts by mass | Compound | Parts by mass |
| Photosensitive member D-5 | A-3 | 8 | Resin A1 | 10 | 125 | Xylene | 8 | Cyclopentanone | 38 | Methylal | 36 |
| Photosensitive member D-6 | A-3 | 8 | Resin A1 | 10 | 125 | Xylene | 14 | Cyclopentanone | 38 | Methylal | 36 |
| Photosensitive member D-7 | A-3 | 8 | Resin A1 | 10 | 125 | Xylene | 21 | Cyclopentanone | 23 | Methylal | 36 |
| Photosensitive member D-8 | A-3 | 8 | Resin A1 | 10 | 125 | Xylene | 16 | Cyclopentanone | 30 | Methylal | 36 |
| Photosensitive member D-9 | A-3 | 8 | Resin A1 | 10 | 125 | Xylene | 16 | Cyclopentanone | 38 | Methylal | 36 |

TABLE 15

| | Drying temperature [° C.] | Drying time [min] | CTL thickness [μm] | γ Content [%] | δ Content [%] | Percentage of γ content to δ content |
|---|---|---|---|---|---|---|
| Photosensitive member D-1 | 120 | 60 | 20 | 0.85 | 0.09 | 944 |
| Photosensitive member D-2 | 120 | 60 | 20 | 1.31 | 0.08 | 1638 |
| Photosensitive member D-3 | 120 | 60 | 20 | 0.62 | 0.12 | 517 |
| Photosensitive member D-4 | 120 | 60 | 20 | 1.28 | 0.13 | 985 |
| Photosensitive member D-5 | 120 | 60 | 20 | 0.83 | 0.38 | 218 |
| Photosensitive member D-6 | 120 | 60 | 20 | 1.28 | 0.29 | 441 |
| Photosensitive member D-7 | 125 | 60 | 20 | 0.68 | 0.01 | 7178 |
| Photosensitive member D-8 | 125 | 60 | 20 | 0.42 | 0.04 | 1050 |
| Photosensitive member D-9 | 125 | 45 | 20 | 0.48 | 0.12 | 400 |

TABLE 16

| | α | | β | | ((β) content/ | γ | | δ | | Another solvent | |
|---|---|---|---|---|---|---|---|---|---|---|---|
| | Compound | Parts by mass | Resin β | Parts by mass | (α) content) × 100 | Compound | Parts by mass | Compound | Parts by mass | Compound | Parts by mass |
| Photosensitive member D-101 | A-3 | 8 | Resin A1 | 10 | 125 | Xylene | 16 | Cyclopentanone | 28 | Methylal | 36 |
| Photosensitive member D-102 | A-3 | 8 | Resin A1 | 10 | 125 | Xylene | 46 | Cyclopentanone | 0 | Methylal | 36 |
| Photosensitive member D-103 | A-3 | 8 | Resin A1 | 10 | 125 | Xylene | 46 | Cyclopentanone | 0 | Methylal | 36 |
| Photosensitive member D-104 | A-3 | 8 | Resin A1 | 10 | 125 | Xylene | 0 | Cyclopentanone | 46 | Methylal | 36 |
| Photosensitive member D-105 | A-3 | 8 | Resin A1 | 10 | 125 | Xylene | 0 | Cyclopentanone | 46 | Methylal | 36 |
| Photosensitive member D-106 | A-3 | 8 | Resin A1 | 10 | 125 | Xylene | 21 | Cyclopentanone | 23 | Methylal | 36 |
| Photosensitive member D-107 | A-3 | 8 | Resin A1 | 10 | 125 | Xylene | 21 | Cyclopentanone | 35 | Methylal | 36 |
| Photosensitive member D-108 | A-3 | 8 | Resin A1 | 10 | 125 | Xylene | 15 | Cyclopentanone | 35 | Methylal | 36 |
| Photosensitive member D-109 | A-3 | 8 | Resin A1 | 10 | 125 | Xylene | 21 | Cyclopentanone | 35 | Methylal | 36 |

TABLE 17

| | Drying temperature [° C.] | Drying time [min] | CTL thickness [μm] | γ Content [%] | δ Content [%] | Percentage of γ content to δ content |
|---|---|---|---|---|---|---|
| Photosensitive member D-101 | 130 | 130 | 20 | 0 | 0 | — |
| Photosensitive member D-102 | 125 | 60 | 20 | 0.65 | 0 | — |
| Photosensitive member D-103 | 120 | 60 | 20 | 2.11 | 0 | — |
| Photosensitive member D-104 | 125 | 60 | 20 | 0 | 0.13 | 0 |
| Photosensitive member D-105 | 120 | 60 | 20 | 0 | 1.35 | 0 |
| Photosensitive member D-106 | 115 | 45 | 20 | 2.31 | 0.09 | 2567 |
| Photosensitive member D-107 | 115 | 60 | 20 | 2.12 | 1.25 | 170 |
| Photosensitive member D-108 | 115 | 60 | 20 | 0.78 | 1.51 | 52 |
| Photosensitive member D-109 | 115 | 60 | 20 | 2.14 | 1.56 | 137 |

TABLE 18

| | α | | β | | ((β) content/ | γ | | δ | | Another solvent | |
|---|---|---|---|---|---|---|---|---|---|---|---|
| | Compound | Parts by mass | Resin β | Parts by mass | (α) content) × 100 | Compound | Parts by mass | Compound | Parts by mass | Compound | Parts by mass |
| Photosensitive member E-1 | A-1 | 8 | Resin A1 | 10 | 125 | Xylene | 16 | Cyclopentanone | 28 | Methylal | 36 |
| Photosensitive member E-2 | A-1 | 8 | Resin A1 | 10 | 125 | Xylene | 21 | Cyclopentanone | 23 | Methylal | 36 |
| Photosensitive member E-3 | A-1 | 8 | Resin A1 | 10 | 125 | Xylene | 16 | Cyclopentanone | 30 | Methylal | 36 |
| Photosensitive member E-4 | A-1 | 8 | Resin A1 | 10 | 125 | Xylene | 21 | Cyclopentanone | 25 | Methylal | 36 |
| Photosensitive member E-5 | A-1 | 8 | Resin A1 | 10 | 125 | Xylene | 8 | Cyclopentanone | 38 | Methylal | 36 |
| Photosensitive member E-6 | A-1 | 8 | Resin A1 | 10 | 125 | Xylene | 14 | Cyclopentanone | 38 | Methylal | 36 |
| Photosensitive member E-7 | A-1 | 8 | Resin A1 | 10 | 125 | Xylene | 21 | Cyclopentanone | 23 | Methylal | 36 |
| Photosensitive member E-8 | A-1 | 8 | Resin A1 | 10 | 125 | Xylene | 16 | Cyclopentanone | 30 | Methylal | 36 |
| Photosensitive member E-9 | A-1 | 8 | Resin A1 | 10 | 125 | Xylene | 16 | Cyclopentanone | 38 | Methylal | 36 |

TABLE 19

| | Drying temperature [° C.] | Drying time [min] | CTL thickness [μm] | γ Content [%] | δ Content [%] | Percentage of γ content to δ content |
|---|---|---|---|---|---|---|
| Photosensitive member E-1 | 120 | 60 | 20 | 0.84 | 0.11 | 764 |
| Photosensitive member E-2 | 120 | 60 | 20 | 1.31 | 0.06 | 2183 |
| Photosensitive member E-3 | 120 | 60 | 20 | 0.60 | 0.14 | 429 |
| Photosensitive member E-4 | 120 | 60 | 20 | 1.30 | 0.11 | 1182 |
| Photosensitive member E-5 | 120 | 60 | 20 | 0.80 | 0.32 | 250 |

TABLE 19-continued

| | Drying temperature [° C.] | Drying time [min] | CTL thickness [μm] | γ Content [%] | δ Content [%] | Percentage of γ content to δ content |
|---|---|---|---|---|---|---|
| Photosensitive member E-6 | 120 | 60 | 20 | 1.24 | 0.31 | 400 |
| Photosensitive member E-7 | 125 | 60 | 20 | 0.65 | 0.01 | 6861 |
| Photosensitive member E-8 | 125 | 60 | 20 | 0.40 | 0.04 | 1000 |
| Photosensitive member E-9 | 125 | 60 | 20 | 0.46 | 0.16 | 288 |

TABLE 20

| | α | | β | | ((β) content/(α) content) × 100 | γ | | δ | | Another solvent | |
|---|---|---|---|---|---|---|---|---|---|---|---|
| | Compound | Parts by mass | Resin β | Parts by mass | | Compound | Parts by mass | Compound | Parts by mass | Compound | Parts by mass |
| Photosensitive member E-101 | A-1 | 8 | Resin A1 | 10 | 125 | Xylene | 16 | Cyclopentanone | 28 | Methylal | 36 |
| Photosensitive member E-102 | A-1 | 8 | Resin A1 | 10 | 125 | Xylene | 46 | Cyclopentanone | 0 | Methylal | 36 |
| Photosensitive member E-103 | A-1 | 8 | Resin A1 | 10 | 125 | Xylene | 46 | Cyclopentanone | 0 | Methylal | 36 |
| Photosensitive member E-104 | A-1 | 8 | Resin A1 | 10 | 125 | Xylene | 0 | Cyclopentanone | 46 | Methylal | 36 |
| Photosensitive member E-105 | A-1 | 8 | Resin A1 | 10 | 125 | Xylene | 0 | Cyclopentanone | 46 | Methylal | 36 |
| Photosensitive member E-106 | A-1 | 8 | Resin A1 | 10 | 125 | Xylene | 21 | Cyclopentanone | 23 | Methylal | 36 |
| Photosensitive member E-107 | A-1 | 8 | Resin A1 | 10 | 125 | Xylene | 21 | Cyclopentanone | 35 | Methylal | 36 |
| Photosensitive member E-108 | A-1 | 8 | Resin A1 | 10 | 125 | Xylene | 15 | Cyclopentanone | 35 | Methylal | 36 |
| Photosensitive member E-109 | A-1 | 8 | Resin A1 | 10 | 125 | Xylene | 21 | Cyclopentanone | 35 | Methylal | 36 |

TABLE 21

| | Drying temperature [° C.] | Drying time [min] | CTL thickness [μm] | γ Content [%] | δ Content [%] | Percentage of γ content to δ content |
|---|---|---|---|---|---|---|
| Photosensitive member E-101 | 130 | 130 | 20 | 0 | 0 | — |
| Photosensitive member E-102 | 125 | 60 | 20 | 0.68 | 0 | — |
| Photosensitive member E-103 | 120 | 60 | 20 | 2.08 | 0 | — |
| Photosensitive member E-104 | 125 | 60 | 20 | 0 | 0.12 | 0 |
| Photosensitive member E-105 | 120 | 60 | 20 | 0 | 1.24 | 0 |
| Photosensitive member E-106 | 115 | 45 | 20 | 2.28 | 0.11 | 2073 |
| Photosensitive member E-107 | 115 | 60 | 20 | 2.2 | 0.13 | 1692 |
| Photosensitive member E-108 | 115 | 60 | 20 | 0.75 | 1.55 | 48 |
| Photosensitive member E-109 | 115 | 60 | 20 | 2.16 | 1.54 | 140 |

TABLE 23

| | Drying temperature [° C.] | Drying time [min] | CTL thickness [μm] | γ Content [%] | δ Content [%] | Percentage of γ content to δ content |
|---|---|---|---|---|---|---|
| Photosensitive member F-1 | 120 | 60 | 20 | 1.40 | 0.12 | 1167 |
| Photosensitive member F-2 | 120 | 60 | 20 | 0.95 | 0.14 | 667 |
| Photosensitive member F-3 | 120 | 60 | 20 | 0.92 | 0.40 | 230 |
| Photosensitive member F-4 | 120 | 60 | 20 | 1.42 | 0.38 | 375 |
| Photosensitive member F-5 | 125 | 60 | 20 | 0.81 | 0.01 | 8550 |
| Photosensitive member F-6 | 125 | 60 | 20 | 0.47 | 0.05 | 1000 |
| Photosensitive member F-7 | 125 | 60 | 20 | 0.47 | 0.18 | 263 |

TABLE 22

| | α | | β | | ((β) content/(α) content) × 100 | γ | | δ | | Another solvent | |
|---|---|---|---|---|---|---|---|---|---|---|---|
| | Compound | Parts by mass | Resin β | Parts by mass | | Compound | Parts by mass | Compound | Parts by mass | Compound | Parts by mass |
| Photosensitive member F-1 | A-1 | 8 | Resin A1 | 10 | 125 | Xylene | 38 | Cyclohexanone | 13 | Methylal | 36 |
| Photosensitive member F-2 | A-1 | 8 | Resin A1 | 10 | 125 | Xylene | 30 | Cyclohexanone | 12 | Methylal | 36 |
| Photosensitive member F-3 | A-1 | 8 | Resin A1 | 10 | 125 | Xylene | 38 | Cyclohexanone | 8 | Methylal | 36 |
| Photosensitive member F-4 | A-1 | 8 | Resin A1 | 10 | 125 | Xylene | 38 | Cyclohexanone | 14 | Methylal | 36 |
| Photosensitive member F-5 | A-1 | 8 | Resin A1 | 10 | 125 | Xylene | 38 | Cyclohexanone | 3 | Methylal | 36 |
| Photosensitive member F-6 | A-1 | 8 | Resin A1 | 10 | 125 | Xylene | 28 | Cyclohexanone | 5 | Methylal | 36 |
| Photosensitive member F-7 | A-1 | 8 | Resin A1 | 10 | 125 | Xylene | 30 | Cyclohexanone | 9 | Methylal | 36 |

TABLE 24

| | α | | β | | ((β) content/(α) content) × 100 | γ | | δ | | Another solvent | |
|---|---|---|---|---|---|---|---|---|---|---|---|
| | Compound | Parts by mass | Resin β | Parts by mass | | Compound | Parts by mass | Compound | Parts by mass | Compound | Parts by mass |
| Photosensitive member F-101 | A-1 | 8 | Resin A1 | 10 | 125 | Xylene | 38 | Cyclohexanone | 13 | Methylal | 36 |
| Photosensitive member F-102 | A-1 | 8 | Resin A1 | 10 | 125 | Xylene | 46 | Cyclohexanone | 0 | Methylal | 36 |
| Photosensitive member F-103 | A-1 | 8 | Resin A1 | 10 | 125 | Xylene | 46 | Cyclohexanone | 0 | Methylal | 36 |
| Photosensitive member F-104 | A-1 | 8 | Resin A1 | 10 | 125 | Xylene | 0 | Cyclohexanone | 46 | Methylal | 36 |
| Photosensitive member F-105 | A-1 | 8 | Resin A1 | 10 | 125 | Xylene | 0 | Cyclohexanone | 46 | Methylal | 36 |
| Photosensitive member F-106 | A-1 | 8 | Resin A1 | 10 | 125 | Xylene | 43 | Cyclohexanone | 3 | Methylal | 36 |
| Photosensitive member F-107 | A-1 | 8 | Resin A1 | 10 | 125 | Xylene | 30 | Cyclohexanone | 10 | Methylal | 36 |
| Photosensitive member F-108 | A-1 | 8 | Resin A1 | 10 | 125 | Xylene | 15 | Cyclohexanone | 35 | Methylal | 36 |
| Photosensitive member F-109 | A-1 | 8 | Resin A1 | 10 | 125 | Xylene | 35 | Cyclohexanone | 10 | Methylal | 36 |

TABLE 25

| | Drying temperature [° C.] | Drying time [min] | CTL thickness [μm] | γ Content [%] | δ Content [%] | Percentage of γ content to δ content |
|---|---|---|---|---|---|---|
| Photosensitive member F-101 | 130 | 130 | 20 | 0 | 0 | — |
| Photosensitive member F-102 | 125 | 60 | 20 | 0.65 | 0 | — |
| Photosensitive member F-103 | 120 | 60 | 20 | 2.11 | 0 | — |
| Photosensitive member F-104 | 130 | 60 | 20 | 0 | 0.13 | 0 |
| Photosensitive member F-105 | 125 | 60 | 20 | 0 | 1.31 | 0 |

TABLE 25-continued

| | Drying temperature [° C.] | Drying time [min] | CTL thickness [μm] | γ Content [%] | δ Content [%] | Percentage of γ content to δ content |
|---|---|---|---|---|---|---|
| Photosensitive member F-106 | 115 | 45 | 20 | 2.31 | 0.09 | 2567 |
| Photosensitive member F-107 | 115 | 60 | 20 | 2.12 | 1.25 | 170 |
| Photosensitive member F-108 | 115 | 60 | 20 | 0.78 | 1.51 | 52 |
| Photosensitive member F-109 | 115 | 60 | 20 | 2.14 | 1.56 | 137 |

TABLE 26

| | α | | β | | ((β) content/(α) content) × 100 | γ | | δ | | Another solvent | |
|---|---|---|---|---|---|---|---|---|---|---|---|
| | Compound | Parts by mass | Resin β | Parts by mass | | Compound | Parts by mass | Compound | Parts by mass | Compound | Parts by mass |
| Photosensitive member G-1 | A-1 | 8 | Resin A1 | 10 | 125 | Toluene | 42 | Cyclopentanone | 3 | Methylal | 36 |

TABLE 27

| | Drying temperature [° C.] | Drying time [min] | CTL thickness [μm] | γ Content [%] | δ Content [%] | Percentage of γ content to δ content |
|---|---|---|---|---|---|---|
| Photosensitive member G-1 | 120 | 60 | 20 | 0.10 | 0.02 | 500 |

TABLE 28

| | α | | β | | ((β) content/(α) content) × 100 | γ | | δ | | Another solvent | |
|---|---|---|---|---|---|---|---|---|---|---|---|
| | Compound | Parts by mass | Resin β | Parts by mass | | Compound | Parts by mass | Compound | Parts by mass | Compound | Parts by mass |
| Photosensitive member G-101 | A-1 | 8 | Resin A1 | 10 | 125 | Toluene | 45 | Cyclopentanone | 3 | Methylal | 36 |

TABLE 29

| | Drying temperature [° C.] | Drying time [min] | CTL thickness [μm] | γ Content [%] | δ Content [%] | Percentage of γ content to δ content |
|---|---|---|---|---|---|---|
| Photosensitive member G-101 | 125 | 60 | 20 | 0 | 0 | — |

Evaluations of Electrophotographic Photosensitive Members

Example A-1

Photosensitive member A-1 was installed in the cyan station of a test apparatus modified from Canon electrophotographic apparatus (copy machine) iR-ADV C5255, and examined for the following properties.

Potential

For measuring surface potentials (dark portion potential and light portion potential) of the electrophotographic photosensitive member, the cartridge of the above-mentioned test apparatus was modified, and the developing device was replaced with a jig to which a potential measuring probe was fixed so as to lie at a position of 178 mm from the end of the electrophotographic photosensitive member (approximately at the center). The measurement was thus performed at the developing position. Applied bias was controlled so that an unexposed portion of the photoelectric photosensitive member would have a dark portion potential of −700 V, and laser beam was adjusted to 0.15 $\rho J/cm_2$ at the surface of the photosensitive member. Then, the light portion potential was measured with light attenuated from the dark portion potential under the above-described conditions. The light portion potential was −221 V. Table 30 shows the difference of the light portion potential of each photosensitive member from the lowest absolute value of the light portion potentials of photosensitive members A-101 to A-110 Sensitivity was ranked according to the following criteria:

A: When exhibited a difference of 25 V or more from the light portion potential of the most sensitive photosensitive member of Comparative Examples A-1 to A-10.

B: When exhibited a difference in the range of 15 V to 24 V from the light portion potential of the most sensitive photosensitive member of Comparative Examples A-1 to A-10.

C: When exhibited a difference in the range of 5 V to 14 V from the light portion potential of the most sensitive photosensitive member of Comparative Examples A-1 to A-10.

D: When exhibited a difference of 4 V or less from the light portion potential of the most sensitive photosensitive member of

Comparative Examples A-1 to A-10

Image Quality

The cyan station of the above-mentioned test apparatus was set, and the initial potential of the electrophotographic photosensitive member was adjusted under the conditions of 23° C. and 50% RH to a dark portion potential (Vd) of −700 V and a light portion potential (Vl) of −200 V by controlling the charging device and the image exposure device.

Then, a screen image with a cyan density of 30% was output as a halftone image. No defect in the image was confirmed.

Examples A-2 to A-35

Photosensitive members A-2 to A-35 were evaluated in the same manner as photosensitive member A-1 of Example 1. The results are shown in Table 30.

Comparative Examples A-1 to A-10

Photosensitive members A-101 to A-110 were evaluated in the same manner as photosensitive member A-1 of Example A-1. The results are shown in Table 30.

Examples B-1 to B-30

Photosensitive members B-1 to B-30 were evaluated in the same manner as photosensitive member A-1 of Example A-1. Table 31 shows the difference of the light portion potential of each photosensitive member from the lowest absolute value of the light portion potentials of photosensitive members B-101 to B-110. Sensitivity was ranked according to the following criteria:

A: When exhibited a difference of 25 V or more from the light portion potential of the most sensitive photosensitive member of Comparative Examples B-1 to B-10.

B: When exhibited a difference in the range of 15 V to 24 V from the light portion potential of the most sensitive photosensitive member of Comparative Examples B-1 to B-10.

C: When exhibited a difference in the range of 5 V to 14 V from the light portion potential of the most sensitive photosensitive member of Comparative Examples B-1 to B-10.

D: When exhibited a difference in the range of 4 V or less from the light portion potential of the most sensitive photosensitive member of Comparative Examples B-1 to B-10.

Comparative Examples B-1 to B-10

Photosensitive members B-101 to B-110 were evaluated in the same manner as photosensitive member A-1 of Example A-1. The results are shown in Table 31.

Examples C-1 to C-30

Photosensitive members C-1 to C-30 were evaluated in the same manner as photosensitive member A-1 of Example A-1. Table 32 shows the difference of the light portion potential of each photosensitive member from the lowest absolute value of the light portion potentials of photosensitive members C-101 to C-110. Sensitivity was ranked according to the following criteria:

A: When exhibited a difference of 25 V or more from the light portion potential of the most sensitive photosensitive member of Comparative Examples C-1 to C-10.

B: When exhibited a difference in the range of 15 V to 24 V from the light portion potential of the most sensitive photosensitive member of Comparative Examples C-1 to C-10.

C: When exhibited a difference in the range of 5 V to 14 V from the light portion potential of the most sensitive photosensitive member of Comparative Examples C-1 to C-10.

D: When exhibited a difference of 4 V or less from the light portion potential of the most sensitive photosensitive member of Comparative Examples C-1 to C-10.

Comparative Examples C-1 to C-10

Photosensitive members C-101 to C-110 were evaluated in the same manner as photosensitive member A-1 of Example A-1. The results are shown in Table 32.

Examples D-1 to D-9

Photosensitive members D-1 to D-9 were evaluated in the same manner as photosensitive member A-1 of Example A-1. Table 33 shows the difference of the light portion potential of each photosensitive member from the lowest absolute value of the light portion potentials of photosensitive members D-101 to D-109. Sensitivity was ranked according to the following criteria:

A: When exhibited a difference of 25 V or more from the light portion potential of the most sensitive photosensitive member of Comparative Examples D-1 to D-9.

B: When exhibited a difference in the range of 15 V to 24 V from the light portion potential of the most sensitive photosensitive member of Comparative Examples D-1 to D-9.

C: When exhibited a difference in the range of 5 V to 14 V from the light portion potential of the most sensitive photosensitive member of Comparative Examples D-1 to D-9.

D: When exhibited a difference of 4 V or less from the light portion potential of the most sensitive photosensitive member of Comparative Examples D-1 to D-9.

Comparative Examples D-1 to D-9

Photosensitive members D-101 to D-109 were evaluated in the same manner as photosensitive member A-1 of Example A-1. The results are shown in Table 33.

Comparative Example D-10

Photosensitive member D-110 was evaluated in the same manner as photosensitive member A-1 of Example A-1. The light portion potential was −415 V, and the difference from the light portion potential of the most sensitive member of Comparative Examples D-1 to D-9 was −10 V.

Comparative Example D-11

Photosensitive member D-111 was evaluated in the same manner as photosensitive member A-1 of Example A-1. The light portion potential was −413 V, and the difference from the light portion potential of the most sensitive member of Comparative Examples D-1 to D-9 was −7 V.

Examples E-1 to E-9

Photosensitive members E-1 to E-9 were evaluated in the same manner as photosensitive member A-1 of Example A-1. Table 34 shows the difference of the light portion potential of each photosensitive member from the lowest absolute value of the light portion potentials of photosensitive members E-101 to E-109. Sensitivity was ranked according to the following criteria:

A: When exhibited a difference of 25 V or more from the light portion potential of the most sensitive photosensitive member of Comparative Examples E-1 to E-9.

B: When exhibited a difference in the range of 15 V to 24 V from the light portion potential of the most sensitive photosensitive member of Comparative Examples E-1 to E-9.

C: When exhibited a difference in the range of 5 V to 14 V from the light portion potential of the most sensitive photosensitive member of Comparative Examples E-1 to E-9.

D: When exhibited a difference of 4 V or less from the light portion potential of the most sensitive photosensitive member of Comparative Examples E-1 to E-9.

Comparative Examples E-1 to E-9

Photosensitive members E-101 to E-109 were evaluated in the same manner as photosensitive member A-1 of Example A-1. The results are shown in Table 34.

Examples F-1 to F-7

Photosensitive members F-1 to F-7 were evaluated in the same manner as photosensitive member A-1 of Example A-1. Table 35 shows the difference of the light portion potential of each photosensitive member from the lowest absolute value of the light portion potentials of photosensitive members F-101 to F-109. Sensitivity was ranked according to the following criteria:

A: When exhibited a difference of 25 V or more from the light portion potential of the most sensitive photosensitive member of Comparative Examples F-1 to F-9.

B: When exhibited a difference in the range of 15 V to 24 V from the light portion potential of the most sensitive photosensitive member of Comparative Examples F-1 to F-9.

C: When exhibited a difference in the range of 5 V to 14 V from the light portion potential of the most sensitive photosensitive member of Comparative Examples F-1 to F-9.

D: When exhibited a difference of 4 V or less from the light portion potential of the most sensitive photosensitive member of Comparative Examples F-1 to F-9.

Comparative Examples F-1 to F-9

Photosensitive members F-101 to F-109 were evaluated in the same manner as photosensitive member A-1 of Example A-1. The results are shown in Table 35.

Example G-1

Photosensitive member G-1 was evaluated in the same manner as photosensitive member A-1 of Example A-1. Table 36 shows the difference in light portion potential from photosensitive member G-101. Sensitivity was ranked according to the following criteria:

A: When exhibited a difference of 25 V or more from Comparative Example G-101.

B: When exhibited a difference in the range of 15 V to 24 V from Comparative Example G-101.

C: When exhibited a difference in the range of 5 V to 14 V from Comparative Example G-101.

D: When exhibited a difference of 4 V or less from Comparative Example G-101.

Comparative Example G-1

Photosensitive member G-101 was evaluated in the same manner as photosensitive member A-1 of Example A-1. The results are shown in Table 36.

TABLE 30

| | | Light portion potential [V] | Difference | Rank |
|---|---|---|---|---|
| Example A-1 | Photosensitive member A-1 | −221 | 27 | A |
| Example A-2 | Photosensitive member A-2 | −218 | 30 | A |
| Example A-3 | Photosensitive member A-3 | −223 | 25 | A |
| Example A-4 | Photosensitive member A-4 | −217 | 31 | A |
| Example A-5 | Photosensitive member A-5 | −223 | 25 | A |
| Example A-6 | Photosensitive member A-6 | −220 | 28 | A |
| Example A-7 | Photosensitive member A-7 | −238 | 10 | C |
| Example A-8 | Photosensitive member A-8 | −229 | 19 | B |
| Example A-9 | Photosensitive member A-9 | −228 | 20 | B |
| Example A-10 | Photosensitive member A-10 | −213 | 35 | A |
| Example A-11 | Photosensitive member A-11 | −227 | 21 | B |
| Example A-12 | Photosensitive member A-12 | −231 | 17 | B |
| Example A-13 | Photosensitive member A-13 | −221 | 27 | A |
| Example A-14 | Photosensitive member A-14 | −228 | 20 | B |
| Example A-15 | Photosensitive member A-15 | −235 | 13 | C |
| Example A-16 | Photosensitive member A-16 | −221 | 27 | A |
| Example A-17 | Photosensitive member A-17 | −230 | 18 | B |
| Example A-18 | Photosensitive member A-18 | −236 | 12 | C |
| Example A-19 | Photosensitive member A-19 | −227 | 21 | B |
| Example A-20 | Photosensitive member A-20 | −232 | 16 | B |
| Example A-21 | Photosensitive member A-21 | −229 | 19 | B |
| Example A-22 | Photosensitive member A-22 | −230 | 18 | B |
| Example A-23 | Photosensitive member A-23 | −228 | 20 | B |
| Example A-24 | Photosensitive member A-24 | −233 | 15 | B |
| Example A-25 | Photosensitive member A-25 | −232 | 16 | B |
| Example A-26 | Photosensitive member A-26 | −239 | 9 | C |
| Example A-27 | Photosensitive member A-27 | −238 | 10 | C |
| Example A-28 | Photosensitive member A-28 | −236 | 12 | C |
| Example A-29 | Photosensitive member A-29 | −240 | 8 | C |
| Example A-30 | Photosensitive member A-30 | −243 | 5 | C |
| Example A-31 | Photosensitive member A-31 | −223 | 25 | A |
| Example A-32 | Photosensitive member A-32 | −222 | 26 | A |
| Example A-33 | Photosensitive member A-33 | −220 | 28 | A |
| Example A-34 | Photosensitive member A-34 | −218 | 30 | A |
| Example A-35 | Photosensitive member A-35 | −220 | 28 | A |
| Comparative Example A-1 | Photosensitive member A-101 | −255 | −7 | D |
| Comparative Example A-2 | Photosensitive member A-102 | −250 | −2 | D |
| Comparative Example A-3 | Photosensitive member A-103 | −248 | 0 | D |
| Comparative Example A-4 | Photosensitive member A-104 | −250 | −2 | D |
| Comparative Example A-5 | Photosensitive member A-105 | −265 | −17 | D |

TABLE 31

| | | Light portion potential [V] | Difference | Rank |
|---|---|---|---|---|
| Example B-1 | Photosensitive member B-1 | −243 | 28 | A |
| Example B-2 | Photosensitive member B-2 | −241 | 30 | A |
| Example B-3 | Photosensitive member B-3 | −242 | 29 | A |
| Example B-4 | Photosensitive member B-4 | −243 | 28 | A |
| Example B-5 | Photosensitive member B-5 | −241 | 30 | A |
| Example B-6 | Photosensitive member B-6 | −241 | 30 | A |
| Example B-7 | Photosensitive member B-7 | −262 | 9 | C |
| Example B-8 | Photosensitive member B-8 | −250 | 21 | B |
| Example B-9 | Photosensitive member B-9 | −249 | 22 | B |
| Example B-10 | Photosensitive member B-10 | −238 | 33 | A |
| Example B-11 | Photosensitive member B-11 | −254 | 17 | B |
| Example B-12 | Photosensitive member B-12 | −251 | 20 | B |
| Example B-13 | Photosensitive member B-13 | −244 | 27 | A |
| Example B-14 | Photosensitive member B-14 | −253 | 18 | B |
| Example B-15 | Photosensitive member B-15 | −261 | 10 | C |
| Example B-16 | Photosensitive member B-16 | −243 | 28 | A |
| Example B-17 | Photosensitive member B-17 | −255 | 16 | B |
| Example B-18 | Photosensitive member B-18 | −264 | 7 | C |
| Example B-19 | Photosensitive member B-19 | −256 | 15 | B |
| Example B-20 | Photosensitive member B-20 | −253 | 18 | B |
| Example B-21 | Photosensitive member B-21 | −265 | 6 | B |
| Example B-22 | Photosensitive member B-22 | −254 | 17 | B |
| Example B-23 | Photosensitive member B-23 | −255 | 16 | B |
| Example B-24 | Photosensitive member B-24 | −250 | 21 | B |
| Example B-25 | Photosensitive member B-25 | −256 | 15 | B |
| Example B-26 | Photosensitive member B-26 | −263 | 8 | C |
| Example B-27 | Photosensitive member B-27 | −265 | 6 | C |
| Example B-28 | Photosensitive member B-28 | −260 | 11 | C |
| Example B-29 | Photosensitive member B-29 | −263 | 8 | C |
| Example B-30 | Photosensitive member B-30 | −264 | 7 | C |
| Comparative Example B-1 | Photosensitive member B-101 | −255 | −7 | D |
| Comparative Example B-2 | Photosensitive member B-102 | −250 | −2 | D |
| Comparative Example B-3 | Photosensitive member B-103 | −248 | 0 | D |
| Comparative Example B-4 | Photosensitive member B-104 | −250 | −2 | D |
| Comparative Example B-5 | Photosensitive member B-105 | −265 | −17 | D |
| Comparative Example B-6 | Photosensitive member B-106 | −260 | −12 | D |
| Comparative Example B-7 | Photosensitive member B-107 | −251 | −3 | D |
| Comparative Example B-8 | Photosensitive member B- | −253 | −5 | D |

TABLE 32

| | | Light portion potential [V] | Difference | Rank |
|---|---|---|---|---|
| Example C-1 | Photosensitive member C-1 | −202 | 29 | A |
| Example C-2 | Photosensitive member C-2 | −203 | 28 | A |
| Example C-3 | Photosensitive member C-3 | −204 | 27 | A |
| Example C-4 | Photosensitive member C-4 | −198 | 33 | A |
| Example C-5 | Photosensitive member C-5 | −202 | 29 | A |
| Example C-6 | Photosensitive member C-6 | −198 | 33 | A |
| Example C-7 | Photosensitive member C-7 | −220 | 11 | C |
| Example C-8 | Photosensitive member C-8 | −215 | 16 | B |
| Example C-9 | Photosensitive member C-9 | −212 | 19 | B |
| Example C-10 | Photosensitive member C-10 | −195 | 36 | A |
| Example C-11 | Photosensitive member C-11 | −211 | 20 | B |
| Example C-12 | Photosensitive member C-12 | −216 | 15 | B |
| Example C-13 | Photosensitive member C-13 | −201 | 30 | A |
| Example C-14 | Photosensitive member C-14 | −213 | 18 | B |
| Example C-15 | Photosensitive member C-15 | −220 | 11 | C |
| Example C-16 | Photosensitive member C-16 | −205 | 26 | A |
| Example C-17 | Photosensitive member C-17 | −213 | 18 | B |
| Example C-18 | Photosensitive member C-18 | −220 | 11 | C |

TABLE 32-continued

| | | Light portion potential [V] | Difference | Rank |
|---|---|---|---|---|
| Example C-19 | Photosensitive member C-19 | −211 | 20 | B |
| Example C-20 | Photosensitive member C-20 | −212 | 19 | B |
| Example C-21 | Photosensitive member C-21 | −210 | 21 | B |
| Example C-22 | Photosensitive member C-22 | −215 | 16 | B |
| Example C-23 | Photosensitive member C-23 | −213 | 18 | B |
| Example C-24 | Photosensitive member C-24 | −213 | 18 | B |
| Example C-25 | Photosensitive member C-25 | −210 | 21 | B |
| Example C-26 | Photosensitive member C-26 | −220 | 11 | C |
| Example C-27 | Photosensitive member C-27 | −221 | 10 | C |
| Example C-28 | Photosensitive member C-28 | −226 | 5 | C |
| Example C-29 | Photosensitive member C-29 | −225 | 6 | C |
| Example C-30 | Photosensitive member C-30 | −218 | 13 | C |
| Comparative Example C-1 | Photosensitive member C-101 | −235 | −4 | D |
| Comparative Example C-2 | Photosensitive member C-102 | −233 | −2 | D |
| Comparative Example C-3 | Photosensitive member C-103 | −231 | 0 | D |
| Comparative Example C-4 | Photosensitive member C-104 | −231 | 0 | D |
| Comparative Example C-5 | Photosensitive member C-105 | −241 | −10 | D |
| Comparative Example C-6 | Photosensitive member C-106 | −236 | −5 | D |
| Comparative Example C-7 | Photosensitive member C-107 | −233 | −2 | D |
| Comparative Example C-8 | Photosensitive member C- | −235 | −4 | D |

TABLE 33

| | | Light portion potential [V] | Difference | Rank |
|---|---|---|---|---|
| Example D-1 | Photosensitive member D-1 | −378 | 27 | A |
| Example D-2 | Photosensitive member D-2 | −375 | 30 | A |
| Example D-3 | Photosensitive member D-3 | −376 | 29 | A |
| Example D-4 | Photosensitive member D-4 | −373 | 32 | A |
| Example D-5 | Photosensitive member D-5 | −380 | 25 | A |
| Example D-6 | Photosensitive member D-6 | −377 | 28 | A |
| Example D-7 | Photosensitive member D-7 | −373 | 32 | A |
| Example D-8 | Photosensitive member D-8 | −380 | 25 | A |
| Example D-9 | Photosensitive member D-9 | −380 | 25 | A |
| Comparative Example D-1 | Photosensitive member D-101 | −410 | −5 | D |
| Comparative Example D-2 | Photosensitive member D-102 | −405 | 0 | D |
| Comparative Example D-3 | Photosensitive member D-103 | −405 | 0 | D |
| Comparative Example D-4 | Photosensitive member D-104 | −406 | −1 | D |
| Comparative Example D-5 | Photosensitive member D-105 | −414 | −9 | D |
| Comparative Example D-6 | Photosensitive member D-106 | −408 | −3 | D |
| Comparative Example D-7 | Photosensitive member D-107 | −407 | −2 | D |
| Comparative Example D-8 | Photosensitive member D-108 | −409 | −4 | D |
| Comparative Example D-9 | Photosensitive member D-109 | −413 | −8 | D |
| Comparative Example D-10 | Photosensitive member D-110 | −418 | −13 | D |

TABLE 34

| | | Light portion potential [V] | Difference | Rank |
|---|---|---|---|---|
| Example E-1 | Photosensitive member E-1 | −379 | 29 | A |
| Example E-2 | Photosensitive member E-2 | −378 | 30 | A |
| Example E-3 | Photosensitive member E-3 | −381 | 27 | A |
| Example E-4 | Photosensitive member E-4 | −377 | 31 | A |
| Example E-5 | Photosensitive member E-5 | −383 | 25 | A |
| Example E-6 | Photosensitive member E-6 | −377 | 31 | A |
| Example E-7 | Photosensitive member E-7 | −376 | 32 | A |
| Example E-8 | Photosensitive member E-8 | −378 | 30 | A |
| Example E-9 | Photosensitive member E-9 | −375 | 33 | A |
| Comparative Example E-1 | Photosensitive member E-101 | −418 | −10 | D |
| Comparative Example E-2 | Photosensitive member E-102 | −408 | 0 | D |
| Comparative Example E-3 | Photosensitive member E-103 | −409 | −1 | D |
| Comparative Example E-4 | Photosensitive member E-104 | −413 | −5 | D |
| Comparative Example E-5 | Photosensitive member E-105 | −412 | −4 | D |
| Comparative Example E-6 | Photosensitive member E-106 | −414 | −6 | D |
| Comparative Example E-7 | Photosensitive member E-107 | −411 | −3 | D |
| Comparative Example E-8 | Photosensitive member E-108 | −415 | −7 | D |
| Comparative Example E-9 | Photosensitive member E-109 | −423 | −15 | D |

TABLE 35

| | | Light portion potential [V] | Difference | Rank |
|---|---|---|---|---|
| Example F-1 | Photosensitive member F-1 | −410 | 14 | C |
| Example F-2 | Photosensitive member F-2 | −412 | 12 | C |
| Example F-3 | Photosensitive member F-3 | −414 | 10 | C |
| Example F-4 | Photosensitive member F-4 | −417 | 7 | C |
| Example F-5 | Photosensitive member F-5 | −415 | 9 | C |
| Example F-6 | Photosensitive member F-6 | −413 | 11 | C |
| Example F-7 | Photosensitive member F-7 | −411 | 13 | C |
| Comparative Example F-1 | Photosensitive member F-101 | −428 | −4 | D |
| Comparative Example F-2 | Photosensitive member F-102 | −424 | 0 | D |
| Comparative Example F-3 | Photosensitive member F-103 | −426 | −2 | D |
| Comparative Example F-4 | Photosensitive member F-104 | −433 | −9 | D |
| Comparative Example F-5 | Photosensitive member F-105 | −431 | −7 | D |
| Comparative Example F-6 | Photosensitive member F-106 | −427 | −3 | D |
| Comparative Example F-7 | Photosensitive member F-107 | −431 | −7 | D |
| Comparative Example F-8 | Photosensitive member F-108 | −428 | −4 | D |
| Comparative Example F-9 | Photosensitive member F-109 | −440 | −16 | D |

TABLE 36

| | | Light portion potential [V] | Difference | Rank |
|---|---|---|---|---|
| Example G-1 | Photosensitive member G-1 | −398 | 13 | C |
| Comparative Example G-1 | Photosensitive member G-101 | −411 | 0 | D |

Preparation of Photosensitive Members H-1 to H-3 and H-101 to H-103

Electrophotographic photosensitive members were prepared in the same process as photosensitive member A-1, except that resin β and the contents of compounds γ and γ were varied according to Table 37 and that the drying temperature and drying time were set as shown in Table 38. Details are shown in Tables 37 and 38. The resulting electrophotographic photosensitive members were evaluated as photosensitive members H-1 to H-3 and H-101 to H-103, respectively.

Examples H-1 to H-3

Photosensitive members H-1 to H-3 were evaluated in the same manner as photosensitive member A-1 of Example A-1. The results are shown in Table 39. Sensitivity was ranked according to the following criteria:

A: When exhibited a difference of 25 V or more from the light portion potential of the most sensitive photosensitive member of Comparative Examples H-1 to H-4.

B: When exhibited a difference in the range of 15 V to 24 V from the light portion potential of the most sensitive photosensitive member of Comparative Examples H-1 to H-4.

C: When exhibited a difference in the range of 5 V to 14 V from the light portion potential of the most sensitive photosensitive member of Comparative Examples H-1 to H-4.

D: When exhibited a difference of 4 V or less from the light portion potential of the most sensitive photosensitive member of Comparative Examples H-1 to H-4.

TABLE 37

| | α | | β | | ((β) content/(α) content) × 100 | γ | | δ | | Another solvent | |
|---|---|---|---|---|---|---|---|---|---|---|---|
| | Compound | Parts by mass | Resin β | Parts by mass | | Compound | Parts by mass | Compound | Parts by mass | Compound | Parts by mass |
| Photosensitive member H-1 | A-1/A-2 | 7.2/0.8 | Resin B2 | 10 | 125 | Xylene | 16 | Cyclopentanone/Cyclohexanone | 24/4 | Methylal | 36 |
| Photosensitive member H-2 | A-1/A-2 | 7.2/0.8 | Resin B2 | 10 | 125 | Xylene/Toluene | 5/11 | Cyclopentanone | 28 | Methylal | 36 |
| Photosensitive member H-3 | A-1/A-2 | 7.2/0.8 | Resin B2 | 10 | 125 | Xylene/Toluene | 5/11 | Cyclopentanone/Cyclohexanone | 24/4 | Methylal | 36 |
| Photosensitive member H-101 | A-1/A-2 | 7.2/0.8 | Resin B2 | 10 | 125 | Xylene | 46 | Cyclopentanone | 0 | Methylal | 36 |
| Photosensitive member H-102 | A-1/A-2 | 7.2/0.8 | Resin B2 | 10 | 125 | Xylene | 0 | Cyclopentanone | 46 | Methylal | 36 |
| Photosensitive member H-103 | A-1/A-2 | 7.2/0.8 | Resin B2 | 10 | 125 | Toluene | 46 | Cyclohexanone | 0 | Methylal | 36 |
| Photosensitive member H-104 | A-1/A-2 | 7.2/0.8 | Resin B2 | 10 | 125 | Toluene | 0 | Cyclohexanone | 46 | Methylal | 36 |

TABLE 38

| | Drying temperature [° C.] | Drying time [min] | CTL thickness [μm] | γ Content [%] | δ Content [%] | Percentage of γ content to δ content |
|---|---|---|---|---|---|---|
| Photosensitive member H-1 | 120 | 60 | 30 | 1.32 | 0.32/0.29 | 216 |
| Photosensitive member H-2 | 120 | 60 | 30 | 0.58/0.46 | 0.20 | 520 |
| Photosensitive member H-3 | 120 | 60 | 30 | 0.74/0.62 | 0.26/0.19 | 302 |
| Photosensitive member H-101 | 120 | 90 | 30 | 1.75 | 0 | — |
| Photosensitive member H-102 | 125 | 60 | 30 | 0 | 0.22 | 0 |
| Photosensitive member H-103 | 120 | 60 | 30 | 0.43 | 0 | — |
| Photosensitive member H-104 | 130 | 60 | 30 | 0 | 1.18 | 0 |

Comparative Examples H-1 to H-4

Photosensitive members H-101 to H-104 were evaluated in the same manner as photosensitive member A-1 of Example A-1. The results are shown in Table 39.

TABLE 39

| | | Light portion potential [V] | Difference | Rank |
|---|---|---|---|---|
| Example H-1 | Photosensitive member H-1 | −225 | 20 | B |
| Example H-2 | Photosensitive member H-2 | −231 | 14 | B |
| Example H-3 | Photosensitive member H-3 | −228 | 17 | B |
| Comparative Example H-1 | Photosensitive member H-101 | −245 | 0 | D |
| Comparative Example H-2 | Photosensitive member H-102 | −258 | −13 | D |
| Comparative Example H-3 | Photosensitive member H-103 | −248 | −3 | D |
| Comparative Example H-4 | Photosensitive member H-104 | −263 | −18 | D |

Preparation of Charge Transport Layer Forming Coating Liquid

Preparation of Coating Liquid 1

A charge transport layer forming coating liquid was prepared by mixing:

10 parts of the compound expressed by formula (A-1) (charge transporting compound or hole transporting compound) and 1.1 parts of the compound expressed by formula (A-2) (charge transporting compound (hole transporting compound);

13.9 parts of resin B1;

17 parts of o-xylene;

30 parts of cyclopentanone; and 29 parts of dimethoxymethane (methylal).

The resulting charge transport layer forming coating liquid was used as coating liquid 1. The detailed composition of the coating liquid is shown in Table 40.

Preparation of Coating Liquids 2 to 53

Each charge transport layer forming coating liquid was prepared in the same manner as coating liquid 1, except that the constituents α', β', γ', and δ' used for coating liquid 1 were replaced with those shown in Table 40. Detailed compositions are shown in Table 40. The resulting charge transport layer forming coating liquids were used as coating liquids 2 to 53.

Preparation of Coating Liquid 101

A charge transport layer forming coating liquid was prepared in the same manner as coating liquid 1, except that constituents α', β', and γ' shown in Table 41 were used without adding δ'. The detailed composition is shown in Table 41. The resulting charge transport layer forming coating liquid was used as coating liquid 101. The constituents were not sufficiently dissolved in coating liquid 101, and the coating liquid was whitish from the beginning.

Preparation of Coating Liquid 102

A charge transport layer forming coating liquid was prepared in the same manner as coating liquid 1, except that constituents α', β', and δ' used for coating liquid 1 were replaced with those shown in Table 41, and that γ' was not added. The detailed composition is shown in Table 41. The resulting charge transport layer forming coating liquid was used as coating liquid 102

Preparation of Coating Liquid 103

A charge transport layer forming coating liquid was prepared in the same manner as coating liquid 1, except that constituents α', β', and γ' used for coating liquid 1 were replaced with those shown in Table 41, and that cyclohexanone was added as a solvent with the content shown in Table 41 instead of solvent δ'. The detailed composition is shown in Table 41. The resulting charge transport layer forming coating liquid was used as coating liquid 103.

Preparation of Coating Liquid 104

A charge transport layer forming coating liquid was prepared in the same manner as coating liquid 1, except that constituents α', β', γ', and δ' used for coating liquid 1 were replaced with those shown in Table 41. The detailed composition is shown in Table 41. The resulting charge transport layer forming coating liquid was used as coating liquid 104.

Preparation of Coating Liquid 105

A charge transport layer forming coating liquid was prepared in the same manner as coating liquid 1, except that constituents α', β', and γ' used for coating liquid 1 were replaced with those shown in Table 41, and that δ' was not added. The detailed composition is shown in Table 41. The resulting charge transport layer forming coating liquid was used as coating liquid 105. The constituents were not sufficiently dissolved in coating liquid 105, and the coating liquid was whitish from the beginning.

Preparation of Coating Liquid 106

A charge transport layer forming coating liquid was prepared in the same manner as coating liquid 1, except that constituents α', β', and δ' used for coating liquid 1 were replaced with those shown in Table 41, and that γ' was not added. The detailed composition is shown in Table 41. The resulting charge transport layer forming coating liquid was used as coating liquid 106.

Preparation of Coating Liquid 107

A charge transport layer forming coating liquid was prepared in the same manner as coating liquid 1, except that constituents α', β', γ', and δ' used for coating liquid 1 were replaced with those shown in Table 41. The detailed composition is shown in Table 41. The resulting charge transport layer forming coating liquid was used as coating liquid 107.

Preparation of Coating Liquid 108

A charge transport layer forming coating liquid was prepared in the same manner as coating liquid 1, except that constituents α' and β' used for coating liquid 1 were replaced with those shown in Table 41, and that ethyl acetate was added as a solvent with the content shown in Table 41 instead of γ' and δ'. The detailed composition is shown in Table 41. The resulting charge transport layer forming coating liquid was used as coating liquid 108. The constituents were not sufficiently dissolved in coating liquid 108, and the coating liquid was whitish from the beginning.

Example I-1

The storage stability of each coating liquid was evaluated as below, according to the results of the following two tests. The evaluation results are shown in Table 40.

Test 1

Coating liquid 1 was placed in a Teflon-coated metal container and sealed therein with a lid. The container was allowed to stand in a thermostatic chamber of 30° C. for 2 days. Then, the container was removed to an environment of 25° C. and allowed to stand there for 7 days. After repeating these operations for 3 months, the container was opened, and the fluidity of the coating liquid was checked.

Test 2

Coating liquid 1 was placed in a Teflon-coated metal container and sealed therein with a lid. After allowing the container to stand in an environment of 25° C. for 3 months, the container was opened, and the fluidity of the coating liquid was checked.

A: The fluidity was good and did not seem to be gelled during either test.

B: In test 1, the viscosity was slightly increased during the test, but the fluidity was kept good. In test 2, the fluidity was kept good and did not seem to be gelled.

C: In test 1, a small portion like gel was found, but the fluidity was recovered by stirring. In test 2, the fluidity was kept good and did not seem to be gelled.

D: In test 1, a slightly gelled portion was found, but the fluidity was recovered by stirring. In test 2, the fluidity was kept to some extent with an increased viscosity and did not seem to be gelled.

E: The coating liquid was gelled in test 1. In test 2, a small portion like gel was found, but the fluidity was recovered by stirring.

Examples I-2 to I-53

The storage stability of the coating liquids was evaluated in the same manner as Example I-1 except that coating liquid 1 was replaced with coating liquid 2 to 53. The results are shown in Table 40.

Comparative Examples I-101 to I-108

The storage stability of the coating liquids was evaluated in the same manner as Example I-1 except that coating liquid 1 was replaced with coating liquids 101 to 108. The results are shown in Table 41.

Preparation of Electrophotographic Photosensitive Member J-1

An aluminum cylinder of 30 mm in diameter and 357.5 mm in length was used as a support member (cylindrical support member).

Then, in a ball mill were dispersed 60 parts of tin oxide-coated barium sulfate particles (PASTRAN PC1, produced by "Mitsui Mining & Smelting), 15 parts of tin oxide particles (TITANIX JR, produced by Tayca), 43 parts of resol-type phenol resin (PHENOLITE J-325, produced by DIC, solid content: 70% by mass), 0.015 part of silicone oil (SH28PA, produced by Dow Corning Toray (formerly Toray Silicone)), 3.6 parts of silicone resin particles (TOSPEARL 120, produced by Momentive Performance Materials (formerly Toshiba Silicone), 50 parts of 2-methoxy-1-propanol, and 50 parts of methanol for 20 hours to yield a coating liquid for the electroconductive layer. This coating liquid was applied to the surface of the support member by dip coating. The resulting coating film was cured by heating at 140° C. for 1 hour to yield a 15 μm-thick electroconductive layer.

Subsequently, 10 parts of copolymerized nylon (Amilan CM8000, produced by Toray) and 30 parts of methoxymethylated 6-nylon resin (Tresin EF-30T, produced by Teikoku Chemical) were dissolved in a mixed solution of 400 parts of methanol and 200 parts of n-butanol to yield a coating liquid for forming an undercoat layer. This coating liquid was applied to the surface of the electroconductive layer by dip coating. The resulting coating film was dried at 100° C. for 30 minutes to yield a 0.45 μm-thick undercoat layer.

Subsequently, a sand mill containing glass beads of 1 mm in diameter was charged with 20 parts of a crystalline hydroxygallium phthalocyanine (charge generating material) whose CuKβ X-ray diffraction spectrum has strong peaks at Bragg angles 2θ of 7.4°±0.2° and 28.2°±0.2°, 0.2 part of the calixarene compound expressed by the following structural formula (1):

(1)

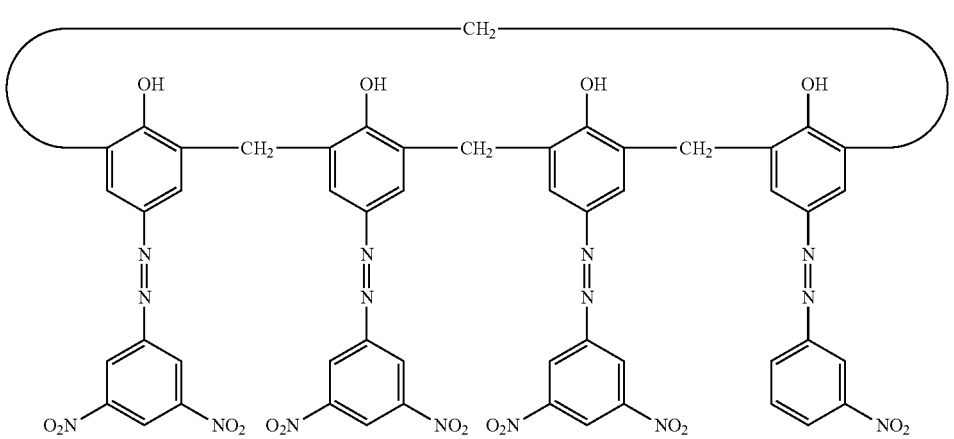

10 parts of a polyvinyl butyral (S-LEC BX-1, produced by Sekisui Chemical), and 600 parts of cyclohexanone. After the materials were dispersed in each other for 4 hours, 700 parts of ethyl acetate was added to the dispersion to yield a coating liquid for forming a charge generating layer. The coating liquid for the charge generating layer was applied to the surface of the undercoat layer by dip coating. The resulting coating film was dried at 80° C. for 15 minutes to yield a 0.17 μm-thick charge generating layer.

Subsequently, coating liquid 1 that had been stored at 25° C. for 3 months was applied to the surface of the charge generating layer by dip coating. The resulting coating film was dried at 120° C. for 60 minutes to yield a 30 μm-thick charge transport layer.

The details of the preparation process of the electrophotographic photosensitive member is shown in Table 42. The resulting electrophotographic photosensitive member was evaluated as photosensitive member J-1.

Preparation of Photosensitive Members J-2 to J-53

Electrophotographic photosensitive members were produced in the same manner as in the preparation of photosensitive member J-1, except that the charge transport layer forming coating liquid was replaced as shown in Table 42. Details are shown in Table 42. The resulting electrophotographic photosensitive members were evaluated as photosensitive members J-2 to J-53.

Preparation of Photosensitive Member J-54

After 0.5 part of fluorine-containing resin (GF-300, produced by Toagosei) was dissolved as a dispersant in a mixed solvent made up of 30 parts of 1,1,2,2,3,3,4-heptafluorocyclopentane (ZEORORA H, produced by Zeon Corporation) and 30 parts of 1-propanol, 30 parts of polytetrafluoroethylene (Lubron L-2, produced by Daikin Industries) was added as a lubricant. The mixture was subjected to dispersion four times at a pressure of 600 kgf/cm$^2$ in a high-pressure disperser (Microfluidizer M-110EH, manufactured by Microfluidics). The resulting dispersion was filtered through a polyflon filter (PF-040, manufactured by ADVANTEC) to yield a lubricant dispersion liquid. To this dispersion liquid were added 90 parts of the hole transporting compound expressed by structural formula A-3, 70 parts of 1,1,2,2,3,3,4-heptafluorocyclopentane, and 70 parts of 1-propanol. The resulting mixture was filtered through a polyflon filter (PF-020, manufactured by ADVANTEC) to yield a coating liquid for forming a second charge transport layer (protective layer). This coating liquid was applied onto the charge transport layer of photosensitive member J-52 by dip coating, and the coating film was dried at 50° C. in the air for 10 minutes. Then, the coating film was irradiated with an electron beam of 3.0 mA in beam current at an accelerating voltage of 150 kV for 1.6 seconds in a nitrogen atmosphere while the support member was being rotated at a rotational speed of 200 rpm. At this time, the absorbed dose of the electron beam was 15 kGy. Subsequently, the coating film was heated in such a manner that the temperature was raised from 25° C. to 125° C. in the nitrogen atmosphere over a period of 30 seconds. The oxygen concentration in the atmosphere in which electron beam irradiation and the subsequent heating and curing reaction were performed was 15 ppm or less. The coating film was then naturally cooled to 25° C. in the air, and heated at 100° C. in the air for 30 minutes. Thus, a 5 μm-thick second charge transport layer (protective layer) was formed. The resulting photosensitive member was evaluated as photosensitive member J-54.

Preparation of Photosensitive Members J-101 to J-108

Electrophotographic photosensitive members were produced in the same manner as in the preparation of photosensitive member J-1, except that the charge transport layer forming coating liquid was replaced as shown in Table 42. Details are shown in Table 42. The resulting electrophotographic photosensitive members were evaluated as photosensitive members J-101 to J-108.

Example J-1

Photosensitive member J-1 was installed in the cyan station of a test apparatus modified from Canon electrophotographic apparatus (copy machine) iR-ADV C5255, and the resulting images were evaluated as below.

The cyan station of the test apparatus was set, and the initial potential of the electrophotographic photosensitive member was adjusted under the conditions of 23° C. and 50% RH to a dark portion potential (Vd) of −700 V and a light portion potential (Vl) of −200 V by controlling the charging device and the image exposure device.

Then, a screen image with a cyan density of 30% was output as a halftone image. No defect in the image was confirmed.

Examples J-2 to J-53

Images were checked for defects in the same manner as in Example J-1 except that the photosensitive member was replaced with the photosensitive member shown in Table 42. Noticeable image defects were not observed in any Example.

Example J-54

Images were checked for defects in the same manner as in Example J-1 except that the photosensitive member was replaced with photosensitive member J-54. Noticeable image defects were not observed.

Examples J-101 to J-108

Images were checked for defects in the same manner as in Example J-1 except that the photosensitive member was replaced with the photosensitive member shown in Table 42.

In Examples J-101, J-104, and J-108, the surfaces of the photosensitive members were not good due to insufficient fluidity.

In Examples J-102, J-103, and J-105 to J-107, noticeable image defects were not observed.

TABLE 40

| | α' | | β' | | ((α') + | γ' | | δ' | |
|---|---|---|---|---|---|---|---|---|---|
| | Compound | mass part | Resin β | mass part | (β'))/Total mass × 100 | Compound | mass part | Compound | mass part |
| Coating liquid 1 | A-1/A-2 | 10/1.1 | Resin B2 | 13.9 | 24.8 | Xylene | 17 | Cyclopentanone | 30 |
| Coating liquid 2 | A-1/A-2 | 7.2/0.8 | Resin B2 | 10 | 18.0 | Xylene | 18 | Cyclopentanone | 33 |
| Coating liquid 3 | A-1/A-2 | 7.2/0.8 | Resin B2 | 10 | 18.0 | Xylene | 9 | Cyclopentanone | 42 |
| Coating liquid 4 | A-1/A-2 | 7.2/0.8 | Resin B2 | 10 | 18.0 | Xylene | 23 | Cyclopentanone | 28 |
| Coating liquid 5 | A-1/A-2 | 7.2/0.8 | Resin B2 | 10 | 18.0 | Xylene | 16 | Cyclopentanone | 29 |
| Coating liquid 6 | A-1/A-2 | 7.2/0.8 | Resin B2 | 10 | 17.8 | Xylene | 21 | Cyclopentanone | 25 |
| Coating liquid 7 | A-1/A-2 | 7.2/0.8 | Resin B2 | 10 | 17.8 | Xylene | 7 | Cyclopentanone | 39 |
| Coating liquid 8 | A-1/A-2 | 7.2/0.8 | Resin B2 | 10 | 18.0 | Xylene | 8 | Cyclopentanone | 37 |
| Coating liquid 9 | A-1/A-2 | 7.2/0.8 | Resin B2 | 10 | 18.0 | Xylene | 22 | Cyclopentanone | 23 |
| Coating liquid 10 | A-1/A-2 | 7.2/0.8 | Resin B2 | 10 | 18.6 | Xylene | 20 | Cyclopentanone | 22 |
| Coating liquid 11 | A-1/A-2 | 7.2/0.8 | Resin B2 | 10 | 18.4 | Xylene | 16 | Cyclopentanone | 56 |
| Coating liquid 12 | A-1/A-2 | 7.2/0.8 | Resin B2 | 10 | 18.0 | Xylene | 12 | Cyclopentanone | 21 |
| Coating liquid 13 | A-1/A-2 | 7.2/0.8 | Resin B2 | 10 | 18.9 | Xylene | 16 | Cyclopentanone | 56 |
| Coating liquid 14 | A-1/A-2 | 7.2/0.8 | Resin B2 | 10 | 17.8 | Xylene | 5 | Cyclopentanone | 25 |
| Coating liquid 15 | A-1/A-2 | 5.2/0.58 | Resin B2 | 7.2 | 13.0 | Xylene | 19 | Cyclopentanone | 35 |
| Coating liquid 16 | A-1/A-2 | 12/1.5 | Resin B2 | 15.5 | 27.6 | Xylene | 17 | Cyclopentanone | 30 |

TABLE 40-continued

| | | | | | | | | | |
|---|---|---|---|---|---|---|---|---|---|
| Coating liquid 17 | A-1/A-2 | 7.2/0.8 | Resin B2 | 10 | 18.0 | Xylene | 18 | Cyclo-pentanone | 33 |
| Coating liquid 18 | A-1/A-2 | 7.2/0.8 | Resin B2 | 10 | 18.0 | Xylene | 18 | Cyclo-pentanone | 33 |
| Coating liquid 19 | A-1/A-2 | 9/1 | Resin B2 | 8 | 18.0 | Xylene | 18 | Cyclo-pentanone | 33 |
| Coating liquid 20 | A-1/A-2 | 5.4/0.6 | Resin B2 | 12 | 18.0 | Xylene | 18 | Cyclo-pentanone | 33 |
| Coating liquid 21 | A-1/A-2 | 12/1.5 | Resin B2 | 15 | 26.5 | Xylene | 20 | Cyclo-pentanone | 22 |
| Coating liquid 22 | A-1/A-2 | 12/1.5 | Resin B2 | 15 | 26.5 | Xylene | 16 | Cyclo-pentanone | 56 |
| Coating liquid 23 | A-1/A-2 | 10/1.1 | Resin B3 | 13.9 | 24.8 | Xylene | 17 | Cyclo-pentanone | 30 |
| Coating liquid 24 | A-1/A-2 | 7.2/0.8 | Resin B3 | 10 | 18.0 | Xylene | 18 | Cyclo-pentanone | 33 |
| Coating liquid 25 | A-1/A-2 | 7.2/0.8 | Resin B3 | 10 | 18.0 | Xylene | 9 | Cyclo-pentanone | 42 |
| Coating liquid 26 | A-1/A-2 | 7.2/0.8 | Resin B3 | 10 | 18.0 | Xylene | 23 | Cyclo-pentanone | 28 |
| Coating liquid 27 | A-1/A-2 | 7.2/0.8 | Resin B3 | 10 | 18.0 | Xylene | 16 | Cyclo-pentanone | 29 |
| Coating liquid 28 | A-1/A-2 | 7.2/0.8 | Resin B3 | 10 | 18.0 | Xylene | 22 | Cyclo-pentanone | 23 |
| Coating liquid 29 | A-1/A-2 | 7.2/0.8 | Resin B3 | 10 | 18.6 | Xylene | 20 | Cyclo-pentanone | 22 |
| Coating liquid 30 | A-1/A-2 | 7.2/0.8 | Resin B3 | 10 | 18.9 | Xylene | 16 | Cyclo-pentanone | 56 |
| Coating liquid 31 | A-1/A-2 | 7.2/0.8 | Resin B3 | 10 | 17.8 | Xylene | 5 | Cyclo-pentanone | 25 |
| Coating liquid 32 | A-1/A-2 | 12/1.5 | Resin B3 | 15.5 | 27.6 | Xylene | 17 | Cyclo-pentanone | 30 |
| Coating liquid 33 | A-1/A-2 | 12/1.5 | Resin B3 | 15 | 26.5 | Xylene | 20 | Cyclo-pentanone | 22 |
| Coating liquid 34 | A-1/A-2 | 12/1.5 | Resin B3 | 15 | 26.5 | Xylene | 16 | Cyclo-pentanone | 56 |
| Coating liquid 35 | A-1/A-2 | 10/1.1 | Resin A1 | 13.9 | 24.8 | Xylene | 17 | Cyclo-pentanone | 30 |
| Coating liquid 36 | A-1/A-2 | 7.2/0.8 | Resin A1 | 10 | 18.0 | Xylene | 18 | Cyclo-pentanone | 33 |
| Coating liquid 37 | A-1/A-2 | 7.2/0.8 | Resin A1 | 10 | 18.0 | Xylene | 9 | Cyclo-pentanone | 42 |
| Coating liquid 38 | A-1/A-2 | 7.2/0.8 | Resin A1 | 10 | 18.0 | Xylene | 23 | Cyclo-pentanone | 28 |
| Coating liquid 39 | A-1/A-2 | 7.2/0.8 | Resin A1 | 10 | 18.0 | Xylene | 16 | Cyclo-pentanone | 29 |
| Coating liquid 40 | A-1/A-2 | 7.2/0.8 | Resin A1 | 10 | 17.8 | Xylene | 21 | Cyclo-pentanone | 25 |
| Coating liquid 41 | A-1/A-2 | 7.2/0.8 | Resin A1 | 10 | 17.8 | Xylene | 7 | Cyclo-pentanone | 39 |
| Coating liquid 42 | A-1/A-2 | 7.2/0.8 | Resin A1 | 10 | 18.0 | Xylene | 8 | Cyclo-pentanone | 37 |
| Coating liquid 43 | A-1/A-2 | 12/1.5 | Resin B2 | 15 | 26.5 | Xylene | 20 | Cyclo-pentanone | 22 |
| Coating liquid 44 | A-1/A-2 | 12/1.5 | Resin B2 | 15 | 26.5 | Xylene | 16 | Cyclo-pentanone | 56 |
| Coating liquid 45 | A-1/A-2/A-4 | 4.8/0.8/2.4 | Resin B3 | 10 | 18.0 | Xylene | 18 | Cyclo-pentanone | 33 |
| Coating liquid 46 | A-1/A-2 | 10/1.1 | Resin B2 | 13.9 | 24.8 | Toluene | 17 | Cyclo-pentanone | 30 |
| Coating liquid 47 | A-1/A-2 | 7.2/0.8 | Resin B2 | 10 | 18.0 | Toluene | 18 | Cyclo-pentanone | 33 |
| Coating liquid 48 | A-1/A-2 | 10/1.1 | Resin B2 | 13.9 | 24.8 | Xylene/Toluene | 9/8 | Cyclo-pentanone | 30 |
| Coating liquid 49 | A-1/A-2 | 7.2/0.8 | Resin B2 | 10 | 18.2 | Xylene/Toluene | 9/8 | Cyclo-pentanone | 33 |
| Coating liquid 50 | A-1/A-2 | 7.2/0.8 | Resin B4 | 10 | 18.0 | Xylene | 18 | Cyclo-pentanone | 33 |
| Coating liquid 51 | A-1/A-2 | 7.2/0.8 | Resin B5 | 10 | 18.0 | Xylene | 18 | Cyclo-pentanone | 33 |
| Coating liquid 52 | A-1/A-2/A-4 | 6/1/3 | Resin A1 | 10 | 21.1 | Xylene | 16 | Cyclo-pentanone | 30 |
| Coating liquid 53 | A-1/A-2 | 7.2/0.8 | Resin B6 | 10 | 18.0 | Xylene | 16 | Cyclo-pentanone | 29 |

TABLE 40-continued

| | | ε | | | | |
|---|---|---|---|---|---|---|
| | (δ')/((γ') + (δ')) × 100 | Compound | mass part | Vapor pressure (KPa) | (δ') + (γ')/((γ) + (δ') + (ε)) × 100 | Evaluation (Tests 1 and 2) (Example I) |
| Coating liquid 1 | 63.8 | Dimethoxymethane | 29 | 15 | 61.8 | A |
| Coating liquid 2 | 64.7 | Dimethoxymethane | 31 | 15 | 62.2 | A |
| Coating liquid 3 | 82.4 | Dimethoxymethane | 31 | 15 | 62.2 | A |
| Coating liquid 4 | 54.9 | Dimethoxymethane | 31 | 15 | 62.2 | A |
| Coating liquid 5 | 64.4 | Dimethoxymethane | 37 | 15 | 54.9 | A |
| Coating liquid 6 | 54.3 | Dimethoxymethane | 37 | 15 | 55.4 | A |
| Coating liquid 7 | 84.8 | Dimethoxymethane | 37 | 15 | 55.4 | A |
| Coating liquid 8 | 82.2 | Dimethoxymethane | 37 | 15 | 54.9 | A |
| Coating liquid 9 | 51.1 | Dimethoxymethane | 37 | 15 | 54.9 | B |
| Coating liquid 10 | 52.4 | Dimethoxymethane | 37 | 15 | 53.2 | B |
| Coating liquid 11 | 77.8 | Dimethoxymethane | 8 | 15 | 90.0 | A |
| Coating liquid 12 | 63.6 | Dimethoxymethane | 49 | 15 | 40.2 | A |
| Coating liquid 13 | 77.8 | Dimethoxymethane | 5 | 15 | 93.5 | B |
| Coating liquid 14 | 83.3 | Dimethoxymethane | 53 | 15 | 36.1 | B |
| Coating liquid 15 | 64.8 | Dimethoxymethane | 33 | 15 | 62.1 | A |
| Coating liquid 16 | 63.8 | Dimethoxymethane | 29 | 15 | 61.8 | B |
| Coating liquid 17 | 64.7 | Dimethoxymethane | 31 | 15 | 62.2 | A |
| Coating liquid 18 | 64.7 | Dimethoxymethane | 31 | 15 | 62.2 | A |
| Coating liquid 19 | 64.7 | Dimethoxymethane | 31 | 15 | 62.2 | A |
| Coating liquid 20 | 64.7 | Dimethoxymethane | 31 | 15 | 62.2 | A |
| Coating liquid 21 | 52.4 | Dimethoxymethane | 37 | 15 | 53.2 | C |
| Coating liquid 22 | 77.8 | Dimethoxymethane | 7 | 15 | 91.1 | D |
| Coating liquid 23 | 63.8 | Dimethoxymethane | 29 | 15 | 61.8 | A |
| Coating liquid 24 | 64.7 | Dimethoxymethane | 31 | 15 | 62.2 | A |
| Coating liquid 25 | 82.4 | Dimethoxymethane | 31 | 15 | 62.2 | A |
| Coating liquid 26 | 54.9 | Dimethoxymethane | 31 | 15 | 62.2 | A |
| Coating liquid 27 | 64.4 | Dimethoxymethane | 37 | 15 | 54.9 | A |
| Coating liquid 28 | 51.1 | Dimethoxymethane | 37 | 15 | 54.9 | B |
| Coating liquid 29 | 52.4 | Dimethoxymethane | 37 | 15 | 53.2 | B |
| Coating liquid 30 | 77.8 | Dimethoxymethane | 5 | 15 | 93.5 | B |
| Coating liquid 31 | 83.3 | Dimethoxymethane | 53 | 15 | 36.1 | B |
| Coating liquid 32 | 63.8 | Dimethoxymethane | 29 | 15 | 61.8 | B |
| Coating liquid 33 | 52.4 | Dimethoxymethane | 37 | 15 | 53.2 | C |
| Coating liquid 34 | 77.8 | Dimethoxymethane | 7 | 15 | 91.1 | D |
| Coating liquid 35 | 63.8 | Dimethoxymethane | 29 | 15 | 61.8 | A |
| Coating liquid 36 | 64.7 | Dimethoxymethane | 31 | 15 | 62.2 | A |
| Coating liquid 37 | 82.4 | Dimethoxymethane | 31 | 15 | 62.2 | A |

TABLE 40-continued

| | | | | | | |
|---|---|---|---|---|---|---|
| Coating liquid 38 | 54.9 | Dimethoxy-methane | 31 | 15 | 62.2 | A |
| Coating liquid 39 | 64.4 | Dimethoxy-methane | 37 | 15 | 54.9 | A |
| Coating liquid 40 | 54.3 | Dimethoxy-methane | 37 | 15 | 55.4 | A |
| Coating liquid 41 | 84.8 | Dimethoxy-methane | 37 | 15 | 55.4 | A |
| Coating liquid 42 | 82.2 | Dimethoxy-methane | 37 | 15 | 54.9 | A |
| Coating liquid 43 | 52.4 | Dimethoxy-methane | 37 | 15 | 53.2 | C |
| Coating liquid 44 | 77.8 | Dimethoxy-methane | 7 | 15 | 91.1 | D |
| Coating liquid 45 | 64.7 | Dimethoxy-methane | 31 | 15 | 62.2 | A |
| Coating liquid 46 | 63.8 | Dimethoxy-methane | 29 | 15 | 61.8 | C |
| Coating liquid 47 | 64.7 | Dimethoxy-methane | 31 | 15 | 62.2 | C |
| Coating liquid 48 | 63.8 | Dimethoxy-methane | 29 | 15 | 61.8 | B |
| Coating liquid 49 | 66.0 | Dimethoxy-methane | 31 | 15 | 61.7 | B |
| Coating liquid 50 | 64.7 | Dimethoxy-methane | 31 | 15 | 62.2 | A |
| Coating liquid 51 | 64.7 | Dimethoxy-methane | 31 | 15 | 62.2 | A |
| Coating liquid 52 | 65.2 | Dimethoxy-methane | 29 | 15 | 61.3 | A |
| Coating liquid 53 | 64.4 | Dimethoxy-methane | 37 | 15 | 54.9 | A |

TABLE 41

| | α' | | β' | | ((α') + | γ' | | δ' | | Others | |
|---|---|---|---|---|---|---|---|---|---|---|---|
| | Compound | mass part | Resin β | mass part | (β'))/Total mass × 100 | Compound | mass part | Compound | mass part | Compound | mass part |
| Coating liquid 101 | A-1/A-2 | 10/1.1 | Resin B2 | 13.9 | 24.8 | Xylene | 47 | — | | — | |
| Coating liquid 102 | A-1/A-2 | 10/1.1 | Resin B2 | 13.9 | 24.8 | — | | Cyclo-pentanone | 47 | — | |
| Coating liquid 103 | A-1/A-2 | 10/1.1 | Resin B2 | 13.9 | 24.8 | Xylene | 17 | — | | Cyclo-hexanone | 30 |
| Coating liquid 104 | A-1/A-2 | 10/1.1 | Resin B2 | 13.9 | 24.8 | Xylene | 28 | Cyclo-pentanone | 23 | — | |
| Coating liquid 105 | A-1/A-2 | 7.2/0.8 | Resin B2 | 10 | 18.8 | Xylene | 47 | — | | — | |
| Coating liquid 106 | A-1/A-2 | 7.2/0.8 | Resin B2 | 10 | 18.8 | — | | Cyclo-pentanone | 47 | — | |
| Coating liquid 107 | A-1/A-2 | 7.2/0.8 | Resin B2 | 10 | 18.0 | Xylene | 28 | Cyclo-pentanone | 23 | — | |
| Coating liquid 108 | A-1/A-2 | 10/1.1 | Resin B2 | 13.9 | 24.8 | — | | — | | Ethyl acetate | 47 |

| | | ε | | | | |
|---|---|---|---|---|---|---|
| | (δ')/((γ') + (δ')) × 100 | Compound | mass part | Vapor pressure (KPa) | ((δ') + (γ'))/((γ') + (δ') + (ε')) × 100 | Evaluation (Tests 1 and 2) (Example I) |
| Coating liquid 101 | 0.0 | Dimethoxy-methane | 31 | 15 | — | Whitened and incompletely dissolved |
| Coating liquid 102 | 100.0 | Dimethoxy-methane | 31 | 15 | — | E |
| Coating liquid 103 | 0.0 | Dimethoxy-methane | 31 | 15 | — | E |
| Coating liquid 104 | 45.1 | Dimethoxy-methane | 31 | 15 | 62.2 | E |
| Coating liquid 105 | 0.0 | Dimethoxy-methane | 31 | 15 | — | Whitened and incompletely dissolved |
| Coating liquid 106 | — | Dimethoxy-methane | 31 | 15 | — | E |

TABLE 41-continued

| | | | | | | |
|---|---|---|---|---|---|---|
| Coating liquid 107 | 45.1 | Dimethoxy-methane | 31 | 15 | 62.2 | E |
| Coating liquid 108 | — | Dimethoxy-methane | 31 | 15 | — | Whitened and incompletely dissolved |

TABLE 42

| | | Drying temperature [° C.] | Drying time [min] | CTL thickness [μm] |
|---|---|---|---|---|
| Example J-1 | Photosensitive member J-1 | 120 | 60 | 30 |
| Example J-2 | Photosensitive member J-2 | 120 | 60 | 30 |
| Example J-3 | Photosensitive member J-3 | 120 | 60 | 30 |
| Example J-4 | Photosensitive member J-4 | 120 | 60 | 30 |
| Example J-5 | Photosensitive member J-5 | 120 | 60 | 30 |
| Example J-6 | Photosensitive member J-6 | 120 | 60 | 30 |
| Example J-7 | Photosensitive member J-7 | 120 | 60 | 30 |
| Example U-8 | Photosensitive member J-8 | 120 | 60 | 30 |
| Example J-9 | Photosensitive member J-9 | 120 | 60 | 30 |
| Example J-10 | Photosensitive member J-10 | 120 | 60 | 30 |
| Example J-11 | Photosensitive member J-11 | 120 | 60 | 30 |
| Example J-12 | Photosensitive member J-12 | 120 | 60 | 30 |
| Example J-13 | Photosensitive member J-13 | 120 | 60 | 30 |
| Example J-14 | Photosensitive member J-14 | 120 | 60 | 30 |
| Example J-15 | Photosensitive member J-15 | 120 | 60 | 30 |
| Example J-16 | Photosensitive member J-16 | 120 | 60 | 30 |
| Example J-17 | Photosensitive member J-17 | 120 | 60 | 30 |
| Example J-18 | Photosensitive member J-18 | 120 | 60 | 30 |
| Example J-19 | Photosensitive member J-19 | 120 | 60 | 30 |
| Example J-20 | Photosensitive member J-20 | 120 | 60 | 30 |
| Example J-21 | Photosensitive member J-21 | 120 | 60 | 30 |
| Example J-22 | Photosensitive member J-22 | 120 | 60 | 30 |
| Example J-23 | Photosensitive member J-23 | 120 | 60 | 30 |
| Example J-24 | Photosensitive member J-24 | 120 | 60 | 30 |
| Example J-25 | Photosensitive member J-25 | 120 | 60 | 30 |
| Example J-26 | Photosensitive member J-26 | 120 | 60 | 30 |
| Example J-27 | Photosensitive member J-27 | 120 | 60 | 30 |
| Example J-28 | Photosensitive member J-28 | 120 | 60 | 30 |
| Example J-29 | Photosensitive member J-29 | 120 | 60 | 30 |
| Example J-30 | Photosensitive member J-30 | 120 | 60 | 30 |
| Example J-31 | Photosensitive member J-31 | 120 | 60 | 30 |
| Example J-32 | Photosensitive member J-32 | 120 | 60 | 30 |
| Example J-33 | Photosensitive member J-33 | 120 | 60 | 30 |
| Example J-34 | Photosensitive member J-34 | 120 | 60 | 30 |
| Example J-35 | Photosensitive member J-35 | 120 | 60 | 30 |
| Example J-36 | Photosensitive member J-36 | 120 | 60 | 30 |
| Example J-37 | Photosensitive member J-37 | 120 | 60 | 30 |
| Example J-38 | Photosensitive member J-38 | 120 | 60 | 30 |
| Example J-39 | Photosensitive member J-39 | 120 | 60 | 30 |
| Example J-40 | Photosensitive member J-40 | 120 | 60 | 30 |
| Example J-41 | Photosensitive member J-41 | 120 | 60 | 30 |
| Example J-42 | Photosensitive member J-42 | 120 | 60 | 30 |
| Example J-43 | Photosensitive member J-43 | 120 | 60 | 30 |
| Example J-44 | Photosensitive member J-44 | 120 | 60 | 30 |
| Example J-45 | Photosensitive member J-45 | 120 | 60 | 30 |
| Example J-46 | Photosensitive member J-46 | 120 | 60 | 30 |
| Example J-47 | Photosensitive member J-47 | 120 | 60 | 30 |
| Example J-48 | Photosensitive member J-48 | 120 | 60 | 30 |
| Example J-49 | Photosensitive member J-49 | 120 | 60 | 30 |
| Example J-50 | Photosensitive member J-50 | 120 | 60 | 30 |
| Example J-51 | Photosensitive member J-51 | 120 | 60 | 30 |
| Example J-52 | Photosensitive member J-52 | 105 | 60 | 18 |
| Example J-53 | Photosensitive member J-53 | 120 | 60 | 30 |
| Example J-101 | Photosensitive member J-101 | 120 | 60 | 30 |
| Example J-102 | Photosensitive member J-102 | 120 | 60 | 30 |
| Example J-103 | Photosensitive member J-103 | 120 | 60 | 30 |
| Example J-104 | Photosensitive member J-104 | 120 | 60 | 30 |
| Example J-105 | Photosensitive member J-105 | 120 | 60 | 30 |

TABLE 42-continued

| | | Drying temperature [° C.] | Drying time [min] | CTL thickness [μm] |
|---|---|---|---|---|
| Example J-106 | Photosensitive member J-106 | 120 | 60 | 30 |
| Example J-107 | Photosensitive member J-107 | 120 | 60 | 30 |
| Example J-108 | Photosensitive member J-108 | 120 | 60 | 30 |

The present disclosure provides a more highly sensitive electrophotographic photosensitive member, and a process cartridge and an electrophotographic apparatus each including the electrophotographic photosensitive member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-229323 filed Nov. 11, 2014 and No. 2015-206608 filed Oct. 20, 2015, which are hereby incorporated by reference herein in their entirety.

What is claimed is:

1. A charge transport layer forming coating liquid comprising:

(α') a charge transport material;

(β') at least one selected from the group consisting of polycarbonate resins and polyester resins;

(γ') at least one of xylene and toluene; and (δ') cyclopentanone, wherein the proportion of (δ') in the charge transport layer forming coating liquid is in the range of 50% by mass to 85% by mass relative to the total mass of (γ') and (δ').

2. The charge transport layer forming coating liquid according to claim 1, wherein (γ') contains 50% by mass to 100% by mass of xylene.

3. The charge transport layer forming coating liquid according to claim 1, wherein the proportion of (δ') in the charge transport layer forming coating liquid is in the range of 53% by mass to 85% by mass relative to the total mass of (γ') and (δ').

4. The charge transport layer forming coating liquid according to claim 1, further comprising (ϵ) a compound having a vapor pressure of 15 kPa or more at 20° C., wherein the total mass of (γ') and (δ') is in the range of 40% by mass to 90% by mass relative to the total mass of (γ'), (δ'), and (ϵ).

5. A method for manufacturing an electrophotographic photosensitive member including a charge generating layer and a charge transport layer, the method comprising:

forming a charge generating layer containing a charge generating material; and forming a charge transport layer by applying the charge generating layer forming coating liquid as set forth in claim 1 to form a coating film and drying the coating film.

* * * * *